US010636604B2

(12) United States Patent
Fujimura et al.

(10) Patent No.: US 10,636,604 B2
(45) Date of Patent: Apr. 28, 2020

(54) ELECTROMAGNETIC RELAY

(71) Applicant: PANASONIC INTELLECTUAL PROPERTY MANAGEMENT CO., LTD., Osaka (JP)

(72) Inventors: Toshinori Fujimura, Mie (JP); Takeshi Nagata, Mie (JP); Tomoyuki Nakagawa, Mie (JP); Takahiro Ota, Mie (JP); Yosuke Sakai, Mie (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 141 days.

(21) Appl. No.: 15/760,057

(22) PCT Filed: Sep. 1, 2016

(86) PCT No.: PCT/JP2016/003992

§ 371 (c)(1),
(2) Date: Mar. 14, 2018

(87) PCT Pub. No.: WO2017/047028

PCT Pub. Date: Mar. 23, 2017

(65) Prior Publication Data

US 2018/0261414 A1 Sep. 13, 2018

(30) Foreign Application Priority Data

Sep. 15, 2015 (JP) ..... 2015-181967
Sep. 15, 2015 (JP) ..... 2015-181974
Sep. 15, 2015 (JP) ..... 2015-181980

(51) Int. Cl.
*H01H 67/02* (2006.01)
*H01H 50/64* (2006.01)
(Continued)

(52) U.S. Cl.
CPC ..... *H01H 50/642* (2013.01); *H01H 1/26* (2013.01); *H01H 50/02* (2013.01);
(Continued)

(58) Field of Classification Search
CPC ..... H01H 50/642
(Continued)

(56) References Cited

U.S. PATENT DOCUMENTS 6,940,375 B2 * 9/2005 Sanada ..... H01H 50/56 335/129
8,111,117 B2 * 2/2012 Minowa ..... H01H 50/28 335/129
(Continued)

FOREIGN PATENT DOCUMENTS

AT 411 303 11/2003
JP 07-296702 11/1995
(Continued)

OTHER PUBLICATIONS

Official Communication issued in International Application No. PCT/JP2016/003992, dated Nov. 8, 2016, along with English translation.
(Continued)

*Primary Examiner* — Alexander Talpalatski
(74) *Attorney, Agent, or Firm* — Greenblum & Bernstein, P.L.C.

(57) ABSTRACT

An electromagnetic relay includes a base, an electromagnet block fixed to the base, an armature which reciprocates when the electromagnet block is switched between an excitation state and a non-excitation state, and a card which slides in association with the movement of the armature. The base includes a rail portion which guides the card upon sliding, and the card includes a slide portion which slides along the rail portion. The rail portion includes a stopper portion
(Continued)

which prevents disengagement of the slide portion from the rail portion.

18 Claims, 23 Drawing Sheets

(51) Int. Cl.

| | |
|---|---|
| ***H01H 50/24*** | (2006.01) |
| ***H01H 50/04*** | (2006.01) |
| ***H01H 1/26*** | (2006.01) |
| ***H01H 50/02*** | (2006.01) |
| ***H01H 50/54*** | (2006.01) |

(52) U.S. Cl.
CPC ..... *H01H 50/026* (2013.01); *H01H 50/042* (2013.01); *H01H 50/24* (2013.01); *H01H 50/54* (2013.01); *H01H 50/64* (2013.01)

(58) Field of Classification Search
USPC ..... 335/129
See application file for complete search history.

(56) References Cited

U.S. PATENT DOCUMENTS

| | | | | |
|---|---|---|---|---|
| 2002/0024412 | A1* | 2/2002 | Wu | H01H 49/00 335/129 |
| 2008/0180197 | A1 | 7/2008 | Kubono et al. | |
| 2008/0231396 | A1 | 9/2008 | Minowa et al. | |
| 2010/0283563 | A1* | 11/2010 | Minowa | H01H 50/36 335/202 |
| 2013/0257566 | A1 | 10/2013 | Li et al. | |

FOREIGN PATENT DOCUMENTS

| | | |
|---|---|---|
| JP | 2008-210776 | 9/2008 |
| JP | 2008-235064 | 10/2008 |
| JP | 2013-229296 | 11/2013 |
| WO | 2010/098082 | 9/2010 |

OTHER PUBLICATIONS

Extended European Search Report for EP 16845906.3 dated Aug. 2, 2018.

* cited by examiner

ELECTROMAGNETIC RELAY

TECHNICAL FIELD

The present invention relates to an electromagnetic relay.

BACKGROUND ART

Electromagnetic relays are known that include a movable iron armature which reciprocates when an electromagnet block is switched between an excitation state and a non-excitation state, and a card which slides in association with the movement of the movable iron armature. Movable contacts provided on a movable contact part are moved in association with the slide of the card so that the movable contacts are brought into contact with and separated from fixed contacts provided on a fixed contact part (refer to Patent Literature 1).

In Patent Literature 1, guide shafts projecting from the card at one end are fitted to guide holes provided in the movable contact part, so that the one end of the card is held to the movable contact part.

A connection part provided at the upper end of the movable iron armature is inserted to an insertion hole serving as a guide portion provided at the other end of the card, so that the other end of the card is held to the movable iron armature. In particular, a fixation projection provided at the connection part of the movable iron armature is fixed to a fixation recess provided at a circumferential edge of the insertion hole.

In Patent Literature 1, the card is thus slidably held such that the one end of the card is fitted to the movable contact part and the other end is fixed to the movable iron armature.

CITATION LIST

Patent Literature

Patent Literature 1: Japanese Patent Application Publication No. 2008-235064

SUMMARY OF INVENTION

Technical Problem

The conventional electromagnetic relay has a problem with the card which may be scratched to cause dust when the card is held to the movable contact part and the movable iron armature. In addition, the card may be rubbed to cause dust when the card slides.

It is an object of the present invention to provide an electromagnetic relay capable of preventing generation of dust caused by scratches on a card.

Solution to Problem

An electromagnetic relay according to the present invention includes: a base; an electromagnet block fixed to the base; an armature configured to reciprocate when the electromagnet block is switched between an excitation state and a non-excitation state; and a card configured to slide in association with a movement of the armature.

The electromagnetic relay further includes a movable contact portion fixed to the base and including a movable contact which moves in association with a slide of the card; and a fixed contact portion fixed to the base and including a fixed contact brought into contact with and separated from the movable contact in association with a movement of the movable contact.

The base includes a rail portion configured to guide the card upon sliding, and the card including a slide portion configured to slide along the rail portion.

The rail portion includes a stopper portion to prevent disengagement of the slide portion from the rail portion.

Advantageous Effects

The present invention can provide the electromagnetic relay capable of preventing generation of dust caused by scratches on the card.

BRIEF DESCRIPTION OF DRAWINGS

FIG. 4A is a perspective view of the coil bobbin as viewed from one side in a front-rear direction, and FIG. 4B is a perspective view of the coil bobbin as viewed from the other side in the front-rear direction.

FIG. 7A is a perspective view of the yoke as viewed from above, and FIG. 7B is a perspective view of the yoke as viewed from below.

FIG. 12A is a perspective view of the first fixed contact portion as viewed from one side in the front-rear direction, FIG. 12B is a perspective view of the first fixed contact portion as viewed from the other side in the front-rear direction, and FIG. 12C is a side view of the first fixed contact portion.

FIG. 13A is a perspective view of the second fixed contact portion as viewed from one side in the front-rear direction, FIG. 13B is a perspective view of the second fixed contact portion as viewed from the other side in the front-rear direction, and FIG. 13C is a side view of the second fixed contact portion.

FIG. 14A is a perspective view of the fixed contact material, FIG. 14B is a front view of the fixed contact material, and FIG. 14C is a side view of the fixed contact material.

FIG. 15A is a perspective view of the base as viewed from one side in the front-rear direction, and FIG. 15B is a perspective view as viewed from the other side in the front-rear direction.

FIG. 19A is a plan view, and FIG. 19B is a side view.

DESCRIPTION OF EMBODIMENTS

An embodiment of the present invention will be described in detail below with reference to the drawings. Hereinafter, the longitudinal direction of an electromagnetic relay (a slide direction of a card: an extending direction of rail portions) is defined as a front-rear direction (X direction), and the short-side direction of the electromagnetic relay (an arrangement direction of the rail portions: an extending direction of a boundary) is defined as a width direction (Y direction). The thickness direction of the electromagnetic relay (a fixation direction of the card and contact portions) is defined as a vertical direction (Z direction).

In the following description, the side on which the contact portions of the electromagnetic relay are arranged is defined as a front side in the front-rear direction, the side on which an electromagnet block is arranged is defined as a rear side in the front-rear direction, and the side on which terminal portions of the contact portion project is defined as a lower side in the vertical direction.

Figure 1:
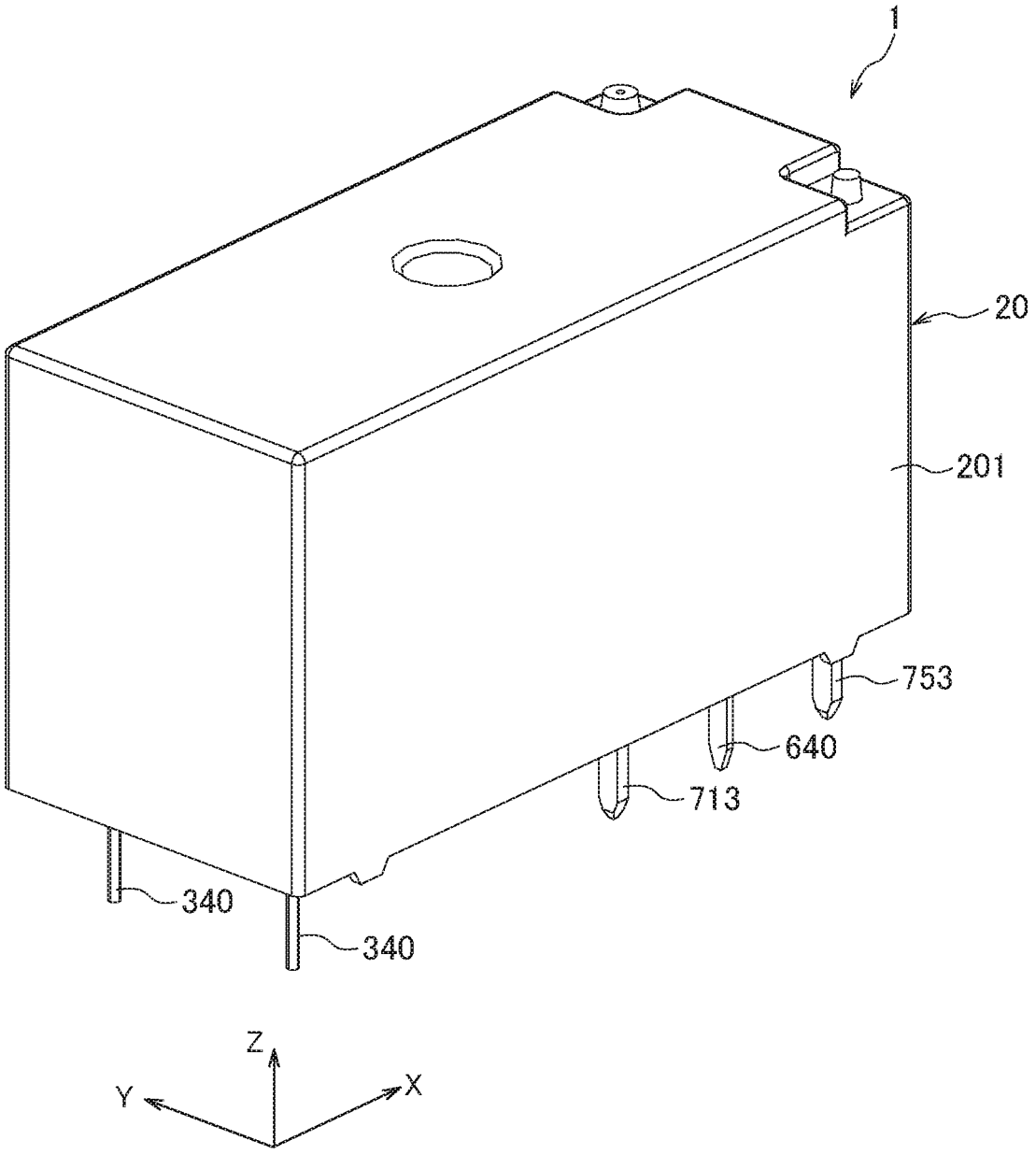
FIG. 1 is a perspective view showing an electromagnetic relay according to an embodiment of the present invention.

The electromagnetic relay 1 according to the present embodiment includes a housing 20 having a substantially rectangular parallelepiped, as illustrated in FIG. 1.

The housing 20 includes a base 200 made from a resin material to which a contact device 10 is attached, and a cover 201 made from a resin material and having a substantially box-like shape with one side open so as to cover the base 200 to which the contact device 10 is attached.

The base 200 is covered with the cover 201 so that the contact device 10 is housed in the housing 20.

Figure 2:
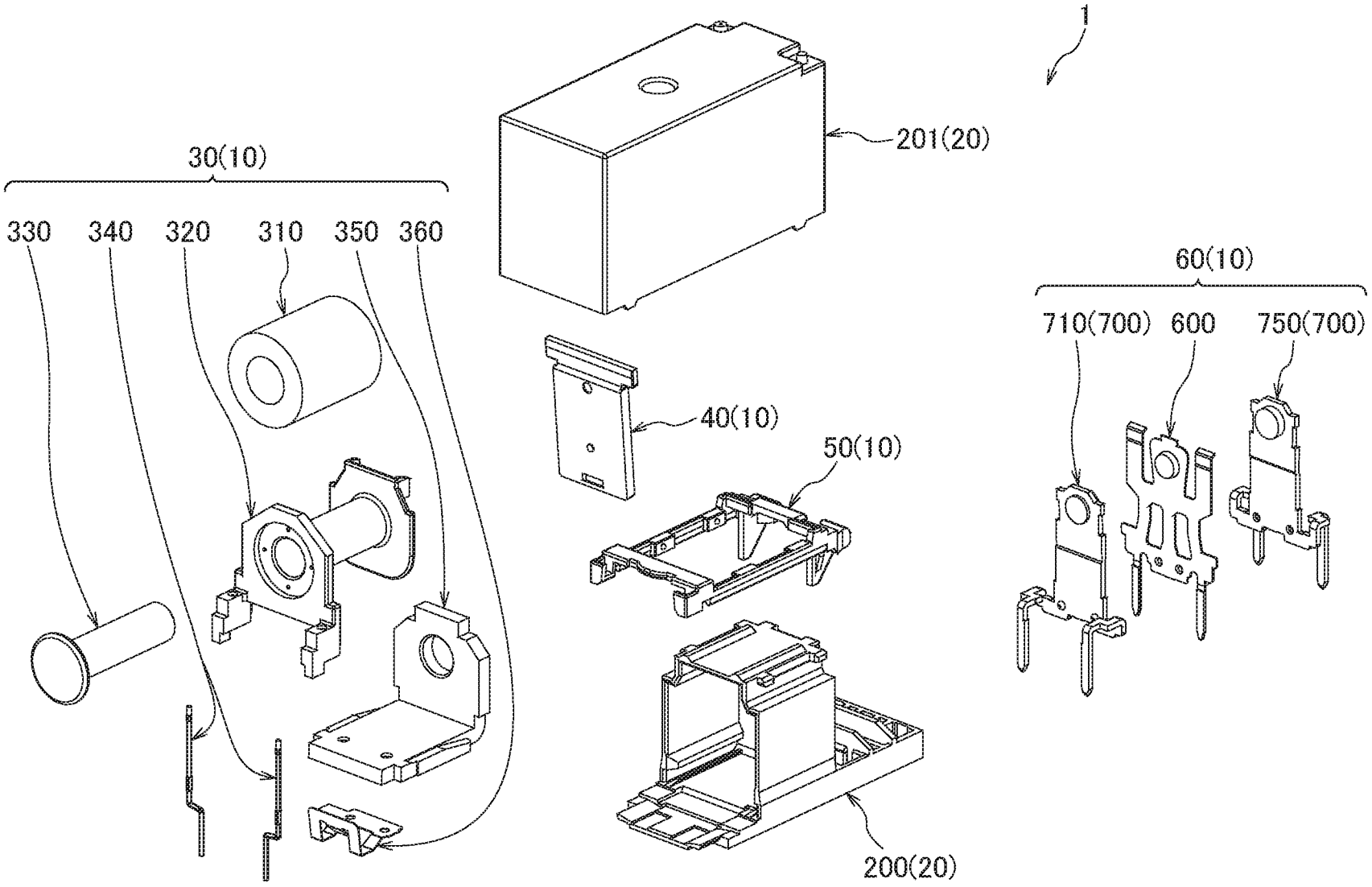
FIG. 2 is an exploded perspective view of the electromagnetic relay according to the embodiment of the present invention.

The contact device 10 includes an electromagnet block 30, an armature 40 which reciprocates when the electromagnet block 30 is switched between an excitation state and a non-excitation state, a card 50 which slides in association with the movement of the armature 40, and a contact portion 60 including a movable contact portion 600 and a fixed contact portion 700 (refer to FIG. 2).

In a state in which the base 200 to which the contact device 10 is attached is covered with the cover 201, an adhesive (not shown) is applied to the base 200 on the rear surface side, so that the contact device 10 is fixed to the base 200, and the base 200 and the cover 201 are fixed together.

Figure 3:
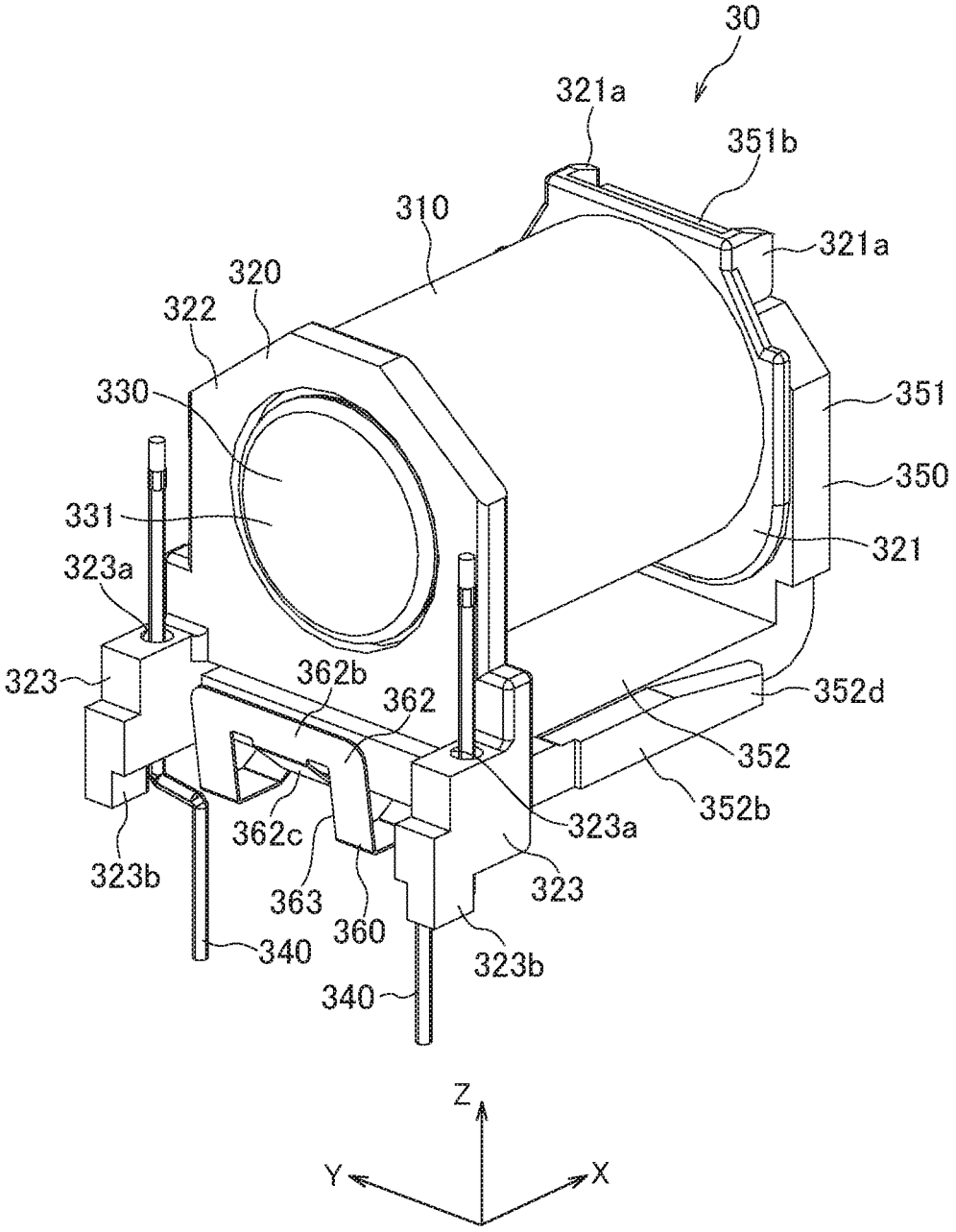
FIG. 3 is a perspective view showing an electromagnet block according to the embodiment of the present invention.

As illustrated in FIG. 2 and FIG. 3, the electromagnet block 30 includes a coil 310, and a coil bobbin 320 having a hollow cylindrical portion 324 on which the coil 310 is wound.

The electromagnet block 30 further includes an iron core 330 inserted into an insertion hole 324*a* provided in the cylindrical portion 324 of the coil bobbin 320, and a substantially L-shaped yoke 350 fixed to a tip 332*a* of the iron core 330.

The electromagnet block 30 further includes coil terminals 340, on which the coil 310 is wound, attached to the coil bobbin 320, and a hinge spring 360 attached to the yoke 350 to bias the armature 40.

Figure 4A:
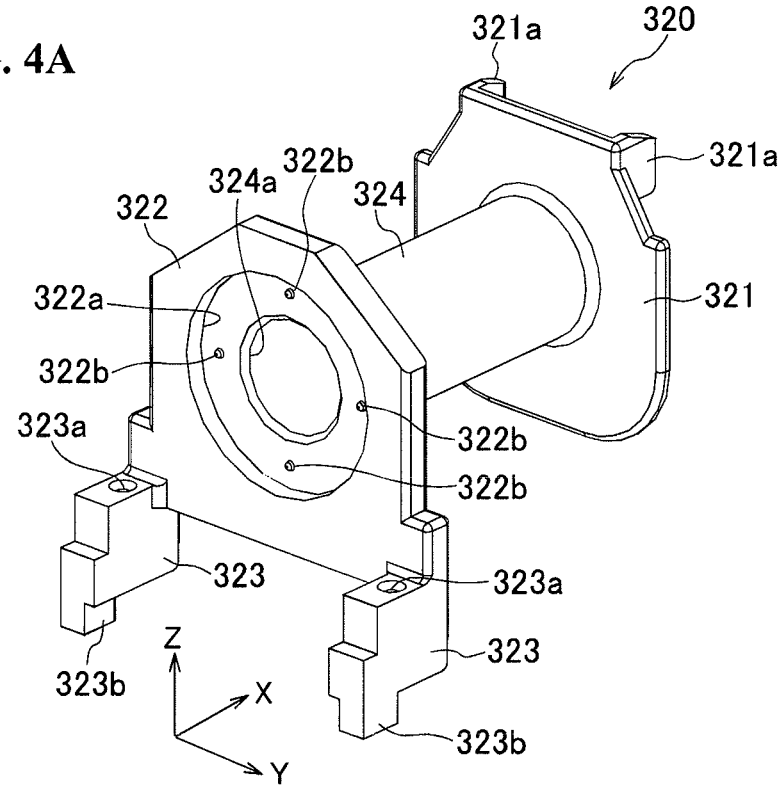
FIGS. 4A and 4B are views showing a coil bobbin according to the embodiment of the present invention.
Figure 4B:
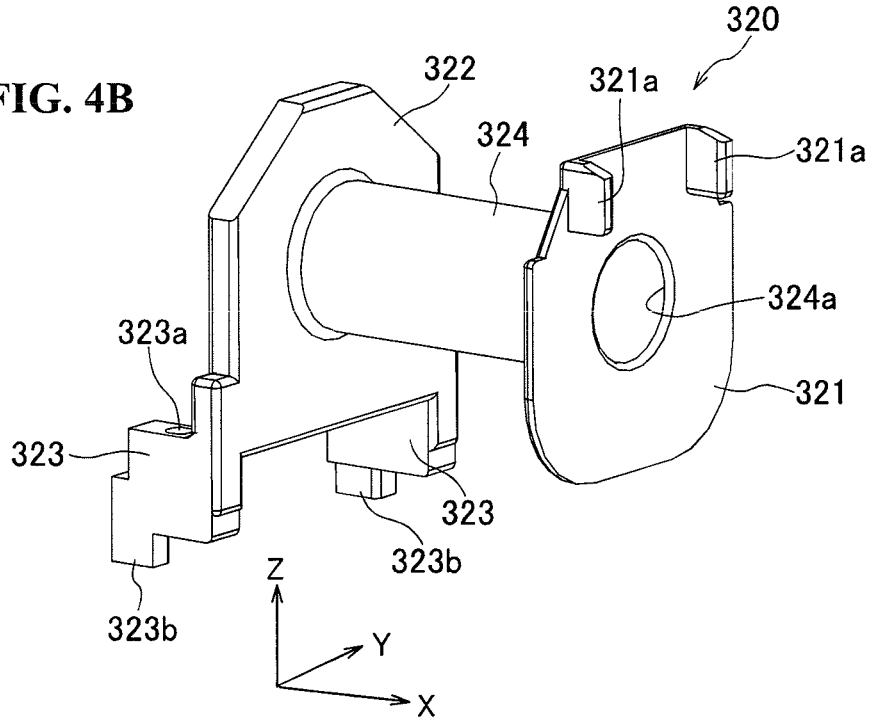

As illustrated in FIG. 4, the coil bobbin 320 includes the cylindrical portion 324 extending in the front-rear direction (in the X direction) on which the coil 310 is wound, and may be formed such that a synthetic resin material is molded. The cylindrical portion 324 is provided with the insertion hole 324*a* into which a shaft 332 of the iron core 330 is inserted.

The cylindrical portion 324 is provided with a front flange 321 at the front end, and provided with a rear flange 322 at the rear end.

In the present embodiment, the front flange 321 and the rear flange 322 are each formed into a tapered shape such that the width in the width direction (in the Y direction) is gradually decreased toward the upper end. The decrease in width on the upper side of each of the front flange 321 and the rear flange 322 avoids obstructing the card 50 by the coil bobbin 320 when the card 50 has a narrow width. Accordingly, a reduction in size of the electromagnetic relay 1 in the width direction (in the Y direction) is achieved.

The front flange 321 is provided with a pair of positioning pieces 321*a* projecting forward in the front-rear direction (in the X direction) at the upper end on both sides of the front flange 321 in the width direction (in the Y direction). The yoke 350 is positioned such that an upper projection 351*b* of the yoke 350 described below is placed between the pair of the positioning pieces 321*a*, 321*a*. The upper projection 351*b* of the yoke 350 is preferably held between the pair of the positioning pieces 321*a*, 321*a* so as to position the yoke 350. The yoke 350 is thus temporarily fixed to the coil bobbin 320, so as to prevent the yoke 350 from being displaced from the coil bobbin 320 when the iron core 330 and the yoke 350 are crimped to the coil bobbin 320 as described below.

The rear flange 322 is provided with a circular recess 322*a* on which a head 331 of the iron core 330 is placed. The circular recess 322*a* is substantially concentric with the insertion hole 324*a*, so that the head 331 is placed on the circular recess 322*a* when the shaft 332 of the iron core 330 is inserted into the insertion hole 324*a*. A plurality of positioning projections 322*b* for positioning the head 331 is provided on the circular recess 322*a* along the circumference of the insertion hole 324*a*.

In the present embodiment, the rear flange 322 is further provided with setting blocks 323 projecting rearward in the front-rear direction (in the X direction) at the lower end on both sides of the rear flange 322 in the width direction (in the Y direction). The setting blocks 323, 323 are mounted on mount portions 232, 232 of the base 200 described below. The setting blocks 323 are each provided with a penetration hole 323*a* penetrating in the vertical direction (in the Z direction). The coil terminals 340 are press-fitted to the penetration holes 323*a* so that the coil terminals 340 are fixed to the coil bobbin 320.

The setting blocks 323 are each provided with a holding piece 323*b* projecting downward at the rear end on the outer side in the width direction (in the Y direction). When the electromagnet block 30 is fixed to the base 200, a held portion 231*a* of a rear projection 231 of the base 200 described below is held between the pair of the holding pieces 323*b*, 323*b*.

Figure 5:
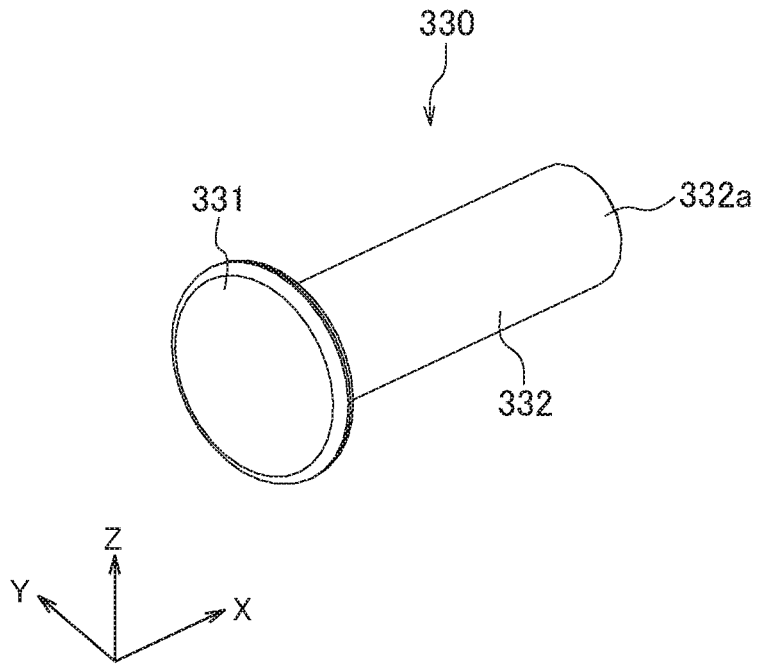
FIG. 5 is a perspective view showing an iron core according to the embodiment of the present invention.

As illustrated in FIG. 5, the iron core 330 made from a magnetic material includes the head 331 having a substantially disk-like shape, and the shaft 332 extending forward in the front-rear direction (in the X direction) from the central portion on the front side of the head 331. The iron core 330 is inserted into the coil bobbin 320 such that the tip 332*a* of the shaft 332 is inserted into the insertion hole 324*a* via the circular recess 322*a*, and the head 331 is placed on the circular recess 322*a*. The head 331 of the iron core 330 serves as a magnetic pole when electricity is supplied to the coil 310.

Figure 6:
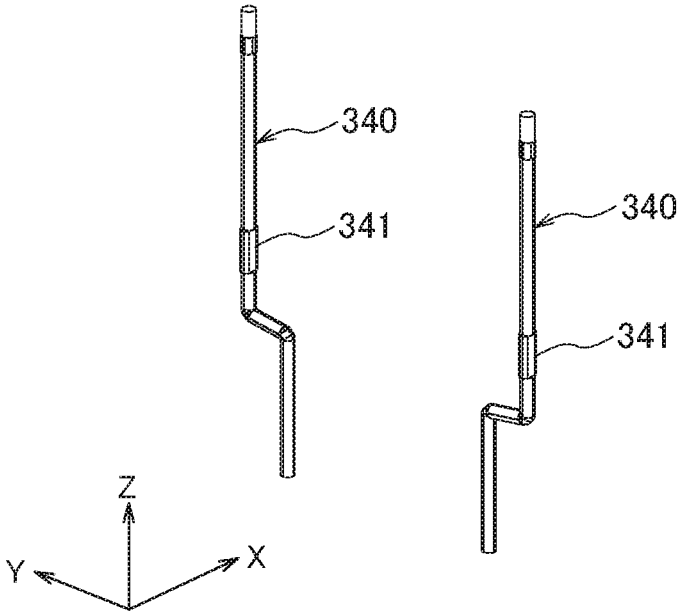
FIG. 6 is a perspective view showing coil terminals according to the embodiment of the present invention.

As illustrated in FIG. 6, the coil terminals 340 are cranked in the present embodiment. The upper ends of the coil terminals 340 are inserted into the penetration holes 323*a* of the setting blocks 323 from the lower side so as to be attached to the coil bobbin 320. The coil terminals 340 are fixed to the setting block 323 such that press-fit portions 341 are press-fitted to the penetration holes 323*a*.

Figure 7A:
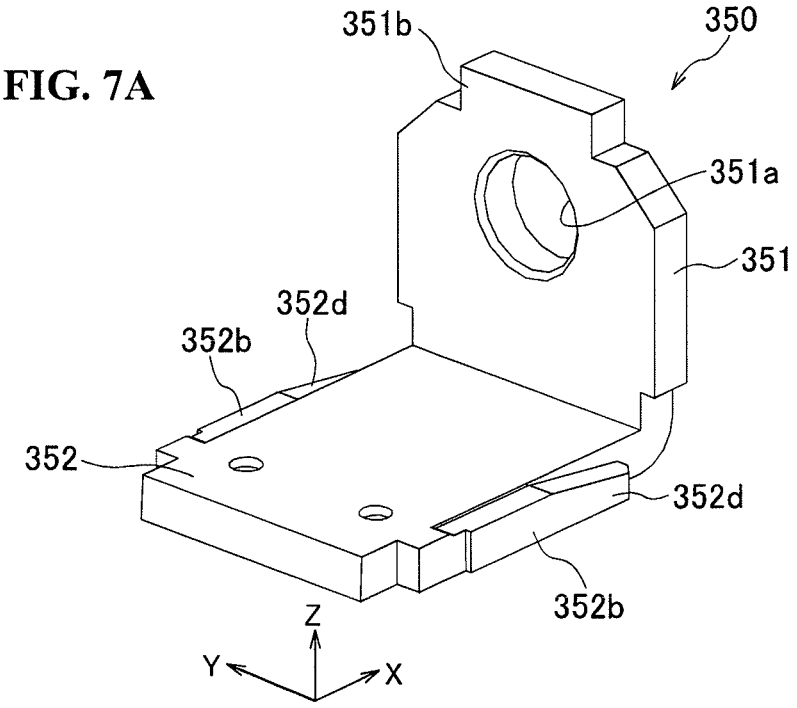
FIGS. 7A and 7B are views showing a yoke according to the embodiment of the present invention.
Figure 7B:
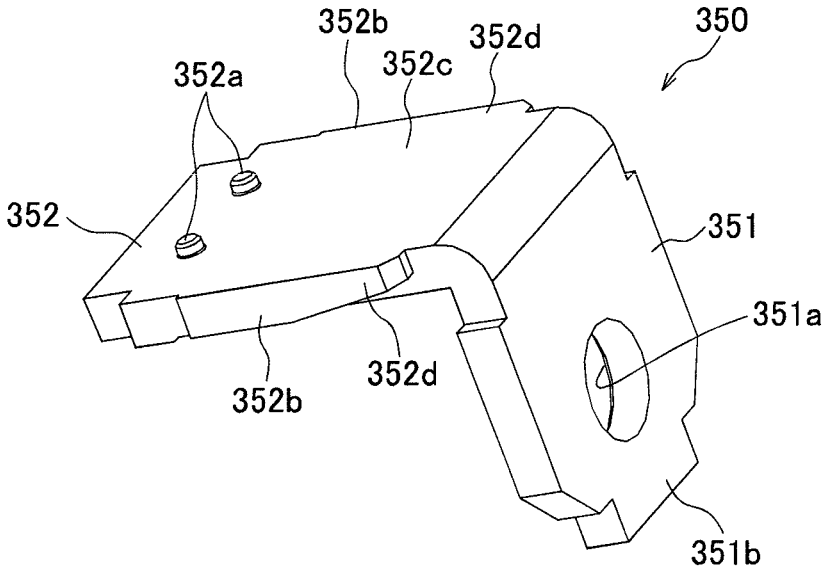

As illustrated in FIG. 7, the substantially L-shaped yoke 350 is defined by a vertical wall portion 351 and a lateral wall portion 352 to form a magnetic path for a magnetic flux around the coil 310. The yoke 350 may be made of a plate-like magnetic material by press molding, for example.

The vertical wall portion 351 is provided in the central portion with a penetration hole 351*a* penetrating in the front-rear direction (in the X direction: the thickness direction of the vertical wall portion 351) into which the tip 332*a* of the shaft 332 of the iron core 330 is inserted. The tip 332*a* of the shaft 332 of the iron core 330 is inserted and crimped to the penetration hole 351*a*, so as to fix the iron core 330 and the yoke 350 together. The vertical wall portion 351 is also provided with the upper projection 351*b* projecting upward at the upper portion. The upper projection 351*b* is positioned between the pair of the positioning pieces 321*a*, 321*a* so as to prevent displacement of the yoke 350 from the coil bobbin 320.

A lower surface 352*c* of the lateral wall portion 352 is provided with projections 352*a* projecting downward. The projections 352*a* are inserted and crimped to penetration holes 361*a* of the hinge spring 360, so that the hinge spring 360 is fixed to the yoke 350. The lateral wall portion 352 is also provided with elongated engagement projections 352*b*, 352*b* on both sides in the width direction (in the Y direction). The elongated engagement projections 352*b*, 352*b* are inserted and engaged with engagement grooves 271, 271 provided in an electromagnet block housing space 270 described below. In the present embodiment, front end portions 352*d*, 352*d* of the elongated engagement projections 352*b*, 352*b* each have a thickness gradually decreased toward the front side so as to be easily inserted into the engagement grooves 271, 271.

Figure 8:
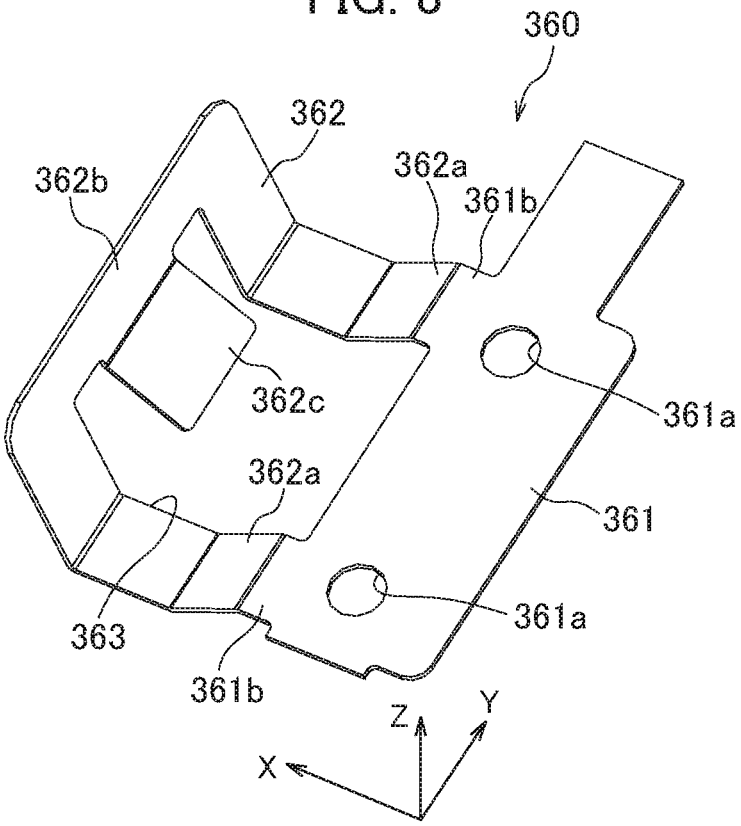
FIG. 8 is a perspective view showing a hinge spring according to the embodiment of the present invention.

As illustrated in FIG. 8, the hinge spring 360 includes a fixed portion 361 fixed to the lateral wall portion 352 of the yoke 350, and a spring portion 362 connected to a rear end 361*b* of the fixed portion 361 and bent into a substantially J-shape in the side view. The hinge spring 360 may be formed such that a plate member of a spring material is bent. The fixed portion 361 is provided with the penetration holes 361*a* described above and fixed to the lower side of the lateral wall portion 352.

The spring portion 362 is provided with a hole portion 363 in the central portion so as to ensure sufficient spring characteristics. In the present embodiment, the spring portion 362 is obtained such that a plate member having a substantially U-shape of which both ends 362*a*, 362*a* are connected to the rear end 361*b* of the fixed portion 361 is bent. The spring portion 362 of the present embodiment is further provided with a fixing piece 362*c* extending forward and downward in the middle of a rear end portion 362*b* of the spring portion 362 in the width direction (in the Y direction). The fixing piece 362*c* is engaged with an engagement recess 41*a* of the armature 40 described below so that the armature 40 is attached to the hinge spring 360.

The electromagnet block 30 having the configuration described above may be assembled as follows:

The coil 310 is wound on the cylindrical portion 324 of the coil bobbin 320. The coil terminals 340, 340 are then press-fitted to the setting blocks 323, 323. One end of the coil 310 is wound on one of the coil terminals 340, 340 press-fitted to the setting blocks 323, 323, and the other end of the coil 310 is wound on the other coil terminal 340.

Before or after this operation, the projections 352*a* provided on the lateral wall portion 352 of the yoke 350 are inserted and crimped to the penetration holes 361*a* provided in the hinge spring 360, so as to fix the hinge spring 360 to the yoke 350.

The upper projection 351*b* of the vertical wall portion 351 of the yoke 350 is positioned between the pair of the positioning pieces 321*a*, 321*a*, and the penetration hole 351*a* is set to communicate with the insertion hole 324*a*. The yoke 350 is arranged such that the surface of the lateral wall portion 352 to which the fixed portion 361 is fixed (the lower surface 352*c* of the lateral wall portion 352) is located on the opposite side of the coil bobbin 320 (faces downward).

The tip 332*a* of the shaft 332 of the iron core 330 is then inserted into the insertion hole 324*a* via the circular recess 322*a* so that the head 331 is placed on the circular recess 322*a*. The tip 332*a* of the shaft 332 is further inserted into the penetration hole 351*a* of the yoke 350 to project forward.

The tip 332*a* of the shaft 332 projecting forward from the penetration hole 351*a* are crimped to the yoke 350, so that the iron core 330 and the yoke 350 are fixed to the coil bobbin 320.

The electromagnet block 30 is thus assembled as described above. The steps of fixing the respective members to assemble the electromagnet block 30 are not limited to this order.

Figure 9:
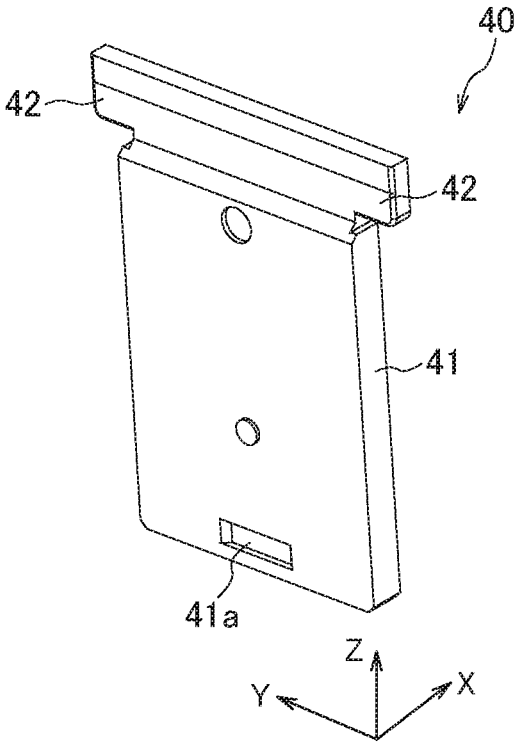
FIG. 9 is a perspective view showing an armature according to the embodiment of the present invention.

As illustrated in FIG. 9, the armature 40 includes an armature body 41 having a substantially rectangular shape, and may be made of a plate-like magnetic material, for example. The armature body 41 with the rectangular shape elongated in the vertical direction (in the Z direction) is provided with the engagement recess 41*a* at a lower-middle portion on the rear side. The fixing piece 362*c* of the hinge spring 360 described above is engaged with the engagement recess 41*a* so that the armature 40 is fixed to the hinge spring 360. The armature 40 is thus attached to the electromagnet block 30 while the armature 40 swings (reciprocates) when the electromagnet block 30 is switched between an excitation state and a non-excitation state.

The armature body 41 includes projections 42, 42 projecting on both sides at the upper portion in the width direction (in the Y direction). The projections 42, 42 are mounted on mount portions 550 described below provided in the card 50, so that the card 50 slides in association with the movement (swing) of the armature 40.

In the present embodiment, the card 50 is held to the base 200 such that the card 50 slidably reciprocates in the front-rear direction (in the X direction) in association with the reciprocating movement of the armature 40.

Figure 10:
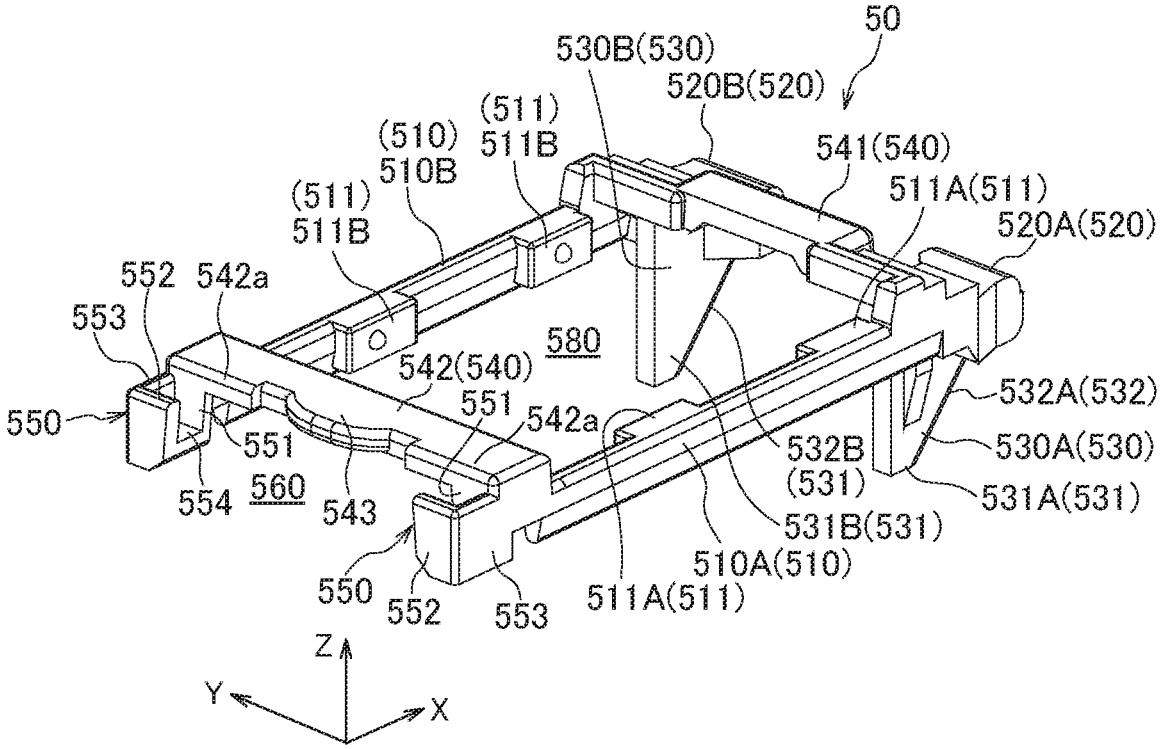
FIG. 10 is a perspective view showing a card according to the embodiment of the present invention.

As illustrated in FIG. 10, the card 50 includes a slide piece 510 extending in the front-rear direction (in the X direction) to slidably reciprocate in the front-rear direction (in the X direction) along a rail portion 290 described below provided in the base 200.

In the present embodiment, the card 50 includes a first slide piece 510A extending in the front-rear direction (in the X direction) to slidably reciprocate in the front-rear direction (in the X direction) along a first rail portion 290A provided in the base 200.

The card 50 also includes a second slide piece 510B extending in the front-rear direction (in the X direction) to slidably reciprocate in the front-rear direction (in the X direction) along a second rail portion 290B provided in the base 200.

The first slide piece 510A and the second slide piece 510B are arranged side by side in the width direction (in the Y direction).

The first slide piece 510A and the second slide piece 510B extend substantially in parallel to each other in the width direction (in the Y direction).

In the present embodiment, the first slide piece 510A and the second slide piece 510B are opposed to each other in the width direction (in the Y direction), and connected to each other via a connection piece (connection portion) 540 extending in the width direction (in the Y direction).

The first slide piece 510A and the second slide piece 510B are thus integrated together with the connection piece (connection portion) 540.

In the present embodiment, the connection piece (connection portion) 540 includes a first connection piece (a first connection portion) 541 connecting one end of the first slide piece 510A in the extending direction (on the front side in the front-rear direction) and one end of the second slide piece 510B in the extending direction (on the front side in the front-rear direction).

The connection piece (connection portion) 540 further includes a second connection piece (a second connection portion) 542 connecting the other end of the first slide piece 510A in the extending direction (on the rear side in the front-rear direction) and the other end of the second slide piece 510B in the extending direction (on the rear side in the front-rear direction).

The card 50 is formed into a substantially frame-like shape defined by the first slide piece 510A, the second slide piece 510B, the first connection piece (the first connection portion) 541, and the second connection piece (the second connection portion) 542. The card 50 having a substantially frame-like shape is provided in the middle with a penetration hole 580 into which a card holding portion 280 provided in the base 200 is inserted.

The card 50 may be formed such that a synthetic resin material is molded.

The card 50 further includes slide portions 511 which slide along the rail portions 290, so that the card 50 held to the base 200 slidably reciprocates in the front-rear direction (in the X direction).

In the present embodiment, the slide portions 511 are provided in the slide pieces 510. The slide pieces 510 slidably reciprocate in the front-rear direction (in the X direction) while being guided by the rail portions 290 via the slide portions 511.

More particularly, a first slide portion 511A is provided in the first slide piece 510A, and a second slide portion 511B is provided in the second slide piece 510B, so that the first slide portion 511A slides along the first rail portion 290A, and the second slide portion 511B slides along the second rail portion 290B.

In the present embodiment, the first slide piece 510A includes two (plural) first slide portions 511A aligned in the front-rear direction (in the X direction: the extending direction of the first slide piece 510A). The second slide piece 510B includes two (plural) second slide portions 511B aligned in the front-rear direction (in the X direction: the extending direction of the second slide piece 510B).

The two first slide portions 511A are located on the inner surface of the first slide piece 510A (on the surface on the penetration hole 580 side) to project toward the penetration hole 580 (inward in the width direction). The two second slide portions 511B are located on the inner surface of the second slide piece 510B (on the surface on the penetration hole 580 side) to project toward the penetration hole 580 (inward in the width direction).

The card 50 having a frame-like shape thus includes the four slide portions 511 in the present embodiment. The four slide portions 511 are arranged such that the first slide portion 511A and the second slide portion 511B located on the front side in the front-rear direction (in the X direction) are opposed to each other in the width direction (in the Y direction), and the first slide portion 511A and the second slide portion 511B located on the rear side in the front-rear direction (in the X direction) are opposed to each other in the width direction (in the Y direction).

Figure 19A:
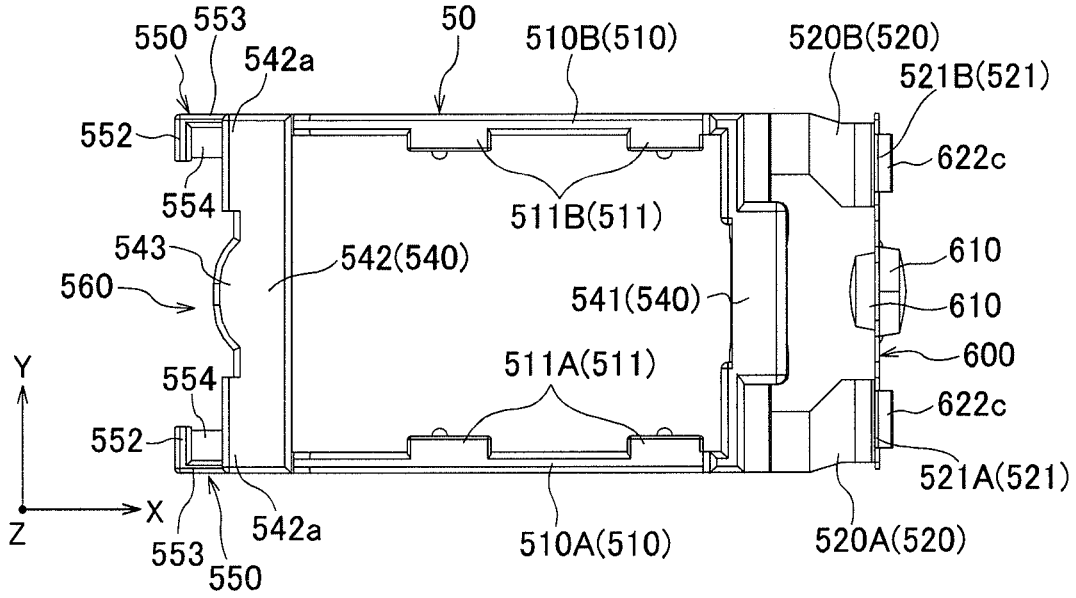
FIGS. 19A and 19B are views schematically showing a state in which the card presses movable contacts according to the embodiment of the present invention.
Figure 19B:
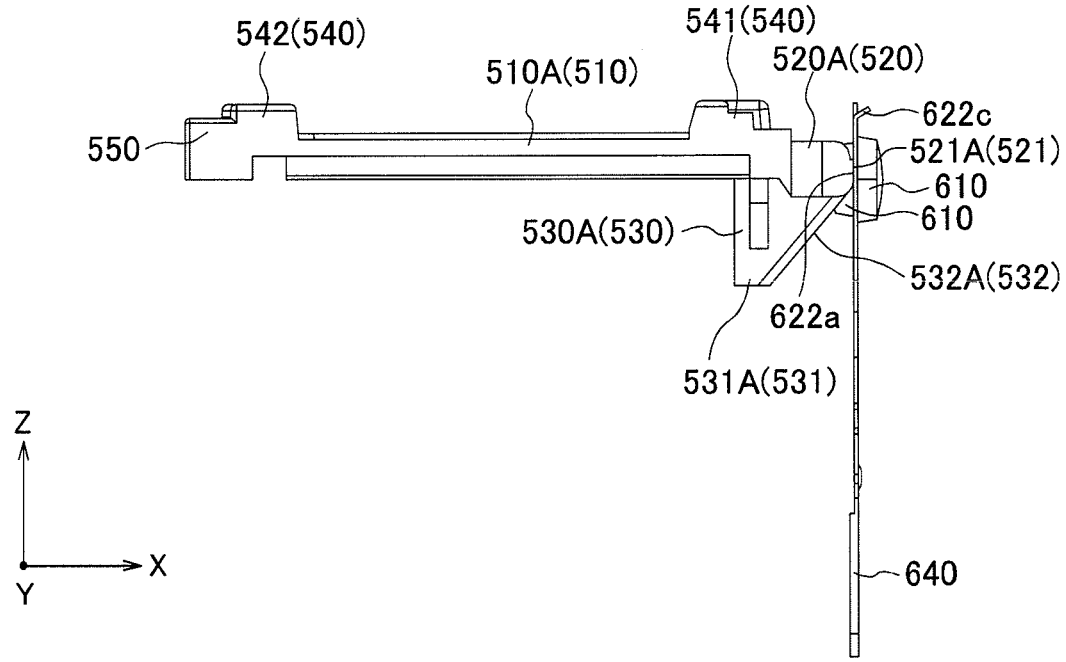

The card 50 further includes a pressing portion 520 which presses a pressed portion 622*a* of the movable contact portion 600 described below (refer to FIG. 19). In the present embodiment, the pressing portion 520 includes a first pressing portion 520A provided in the first slide piece 510A and projecting forward in the front-rear direction (in the X direction) from the first connection piece (the first connection portion) 541, and a second pressing portion 520B provided in the second slide piece 510B and projecting forward in the front-rear direction (in the X direction) from the first connection piece (the first connection portion) 541.

The pressing portions 520 projecting forward on both sides of the card 50 in the width direction (in the Y direction) press the pressed portions 622*a* of the movable contact portion 600, so as to move movable contacts 610 of the movable contact portion 600 in the front-rear direction (in the X direction) more reliably.

In the present embodiment, the card 50 is put and moved in the vertical direction (in the Z direction: the direction perpendicular to the sliding direction of the card 50) so as to be attached to the base 200.

The card 50 is attached to the base 200 such that the card 50 is put downward in a state in which the base 200 is located below the card 50 (parallel movement).

The pressing portions 520 are provided with leading portions 530 projecting downward in a state in which the card 50 is put downward to be attached to the base 200. The leading portions 530 are provided so as to move the upper end of the movable contact portion 600 forward in the front-rear direction (in the X direction) to lead the pressing portions 520 to the pressed portions 622*a* of the movable contact portion 600 when the card 50 is put downward to be attached to the base 200.

In particular, the leading portions 530 each have a tapered shape gradually decreased in width toward the lower side in the side view (as viewed in the width direction) so that a tip 531 is located behind a front end 521 of the pressing portion 520.

The leading portions 530 are each provided with an inclined surface 532 on the front side (toward the movable contact portion 600) inclined downward so as to gradually increase a distance from the movable contact portion 600 in the state in which the card 50 is put downward so as to be attached to the base 200. In the present embodiment, the inclined surface 532 connects the front end 521 of the pressing portion 520 and the tip 531 of the leading portion 530.

The pressing portions 520 are respectively provided with the leading portions 530. In particular, the first pressing portion 520A is provided with a first leading portion 530A including a tip 531A and an inclined surface 532A connecting a front end 521A of the first pressing portion 520A and the tip 531A. The second pressing portion 520B is provided with a second leading portion 530B including a tip 531B and an inclined surface 532B connecting a front end 521B of the second pressing portion 520B and the tip 531B.

The card 50 includes the mount portions 550 on which the projections 42 of the armature 40 are mounted so that the card 50 moves in association with the movement of the armature body 41.

In particular, the mount portions 550, 550 project rearward in the front-rear direction (in the X direction) on both sides of the second connection piece (the second connection portion) 542 in the width direction (in the Y direction). The pair of the projections 42, 42 is mounted on the respective mount portions 550, 550.

The mount portions 550, 550 each include a front wall 551 elongated downward from a rear end 542*a* of the second connection piece (the second connection portion) 542, a rear wall 552 located behind the front wall 551 in the front-rear direction (in the X direction) and opposed to the front wall 551 in the front-rear direction (in the X direction), an outer wall 553 connecting the front wall 551 and the rear wall 552 on the outer side in the width direction (in the Y direction), and a bottom wall 554 connected to the respective lower ends of the front wall 551, the rear wall 552, and the outer wall 553.

The mount portions 550, 550 are arranged such that the respective front walls 551, rear walls 552, outer walls 553 and bottom walls 554 define an opening open on the upper side in the vertical direction (in the Z direction) and on the inner side in the width direction (in the Y direction). A space 560 is thus provided between the respective mount portions 550 through which the armature body 41 can be introduced.

In the present embodiment, in a state in which the pair of the projections 42, 42 is located on the upper side and the engagement recess 41*a* is open rearward, the pair of the projections 42, 42 are mounted on the mount portions 550, 550 from above, and the armature body 41 is located in the space 560 (arranged between the respective mount portions 550, 550), so that the armature 40 is arranged to be movable together with the card 50.

In the present embodiment, an arc-like protrusion 543 is provided to protrude rearward in the front-rear direction (in the X direction) in the middle of the second connection piece (the second connection portion) 542 in the width direction (in the Y direction). The arc-like protrusion 543 regulates shaking of the armature 40.

The contact portion 60 includes the fixed contact portion 700 provided with fixed contacts 711 and 751, and the movable contact portion 600 provided with the movable contacts 610 brought into contact with and separated from the fixed contacts 711 and 751.

Figure 11:
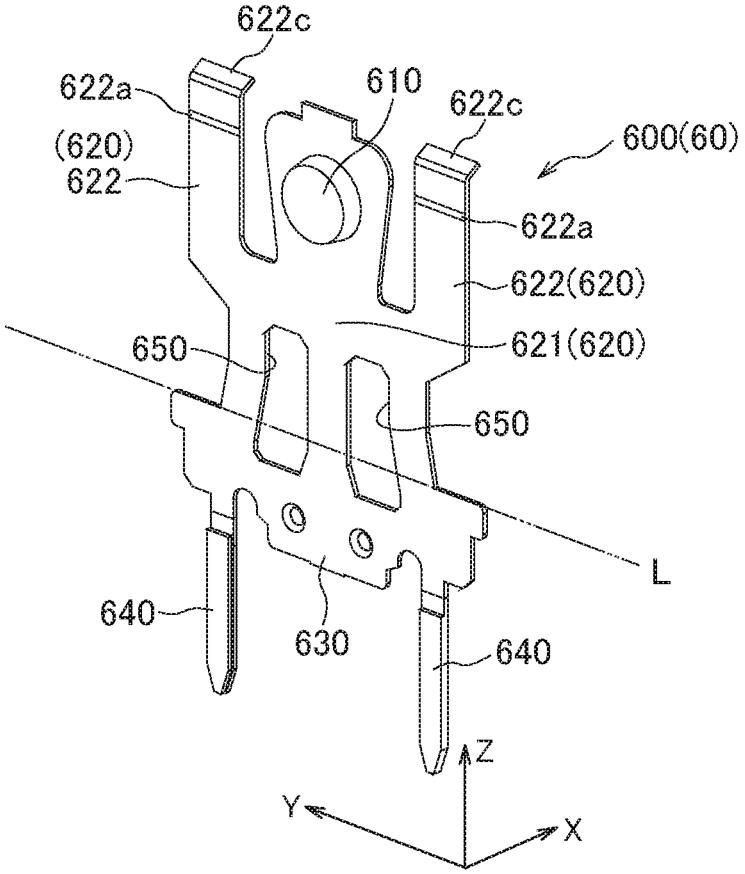
FIG. 11 is a perspective view showing a movable contact portion according to the embodiment of the present invention.

As illustrated in FIG. 11, the movable contact portion 600 including the movable contacts 610 further includes an elastically-deformed portion 620 elastically deformed when pressed by the respective pressing portions 520 (the first pressing portion 520A and the second pressing portion 520B), and a press-fit portion 630 press-fitted to the base 200 so that the movable contact portion 600 is fixed to the base 200. The movable contact portion 600 excluding the movable contacts 610 may be made of a single metal plate having a plate thickness and a plate width by press molding, for example.

In the present embodiment, the elastically-deformed portion 620 includes a body portion 621 to which the movable contacts 610 are attached, and branched portions 622, 622 branched upward on both sides of the body portion 621 in the width direction (in the Y direction). The body portion 621 is provided with a penetration hole (not shown) to which the movable contacts 610 are inserted and fixed. In the present embodiment, the movable contacts 610 are fixed to the body portion 621 on both sides in the front-rear direction (in the X direction: the thickness direction).

The branched portions 622, 622 are provided with the pressed portions 622*a*, 622*a* pressed by the pressing portions 520 (the first pressing portion 520A and the second pressing portion 520B) on the respective rear surfaces in the front-rear direction (in the X direction).

The pressed portions 622*a*, 622*a* are pressed by the pressing portions 520 (the first pressing portion 520A and the second pressing portion 520B), and the elastically-deformed portion 620 (the body portion 621 and the branched portions 622, 622) is thus elastically deformed forward in the front-rear direction (in the X direction), so that the movable contacts 610 are moved forward.

The movable contact portion 600 is pressed forward by the pressing portions 520 (the first pressing portion 520A and the second pressing portion 520B) even when the card 50 is located at the back-most position in the reciprocating slide range (when the electromagnet block 30 is in a non-excitation state). In particular, when the movable contact portion 600 and the card 50 are attached to the base 200, the elastically-deformed portion 620 of the movable contact portion 600 is shifted forward from a position in a free state (in a state in which only the movable contact portion 600 is attached to the base 200: a state in which the movable contact portion 600 is not pressed by the card 50). The movable contact portion 600 is thus attached to the base 200 while the elastically-deformed portion 620 is biased rearward.

In the present embodiment, the width of each of the first pressing portion 520A and the second pressing portion 520B in the width direction (the width in the Y direction) is greater than the width of the respective branched portions 622, 622

(the width in the Y direction). Namely, substantially the entire surfaces of the pressed portions 622*a*, 622*a* provided in the branched portions 622, 622 are brought into contact with (in surface contact with) the first pressing portion 520A and the second pressing portion 520B.

Figure 18:
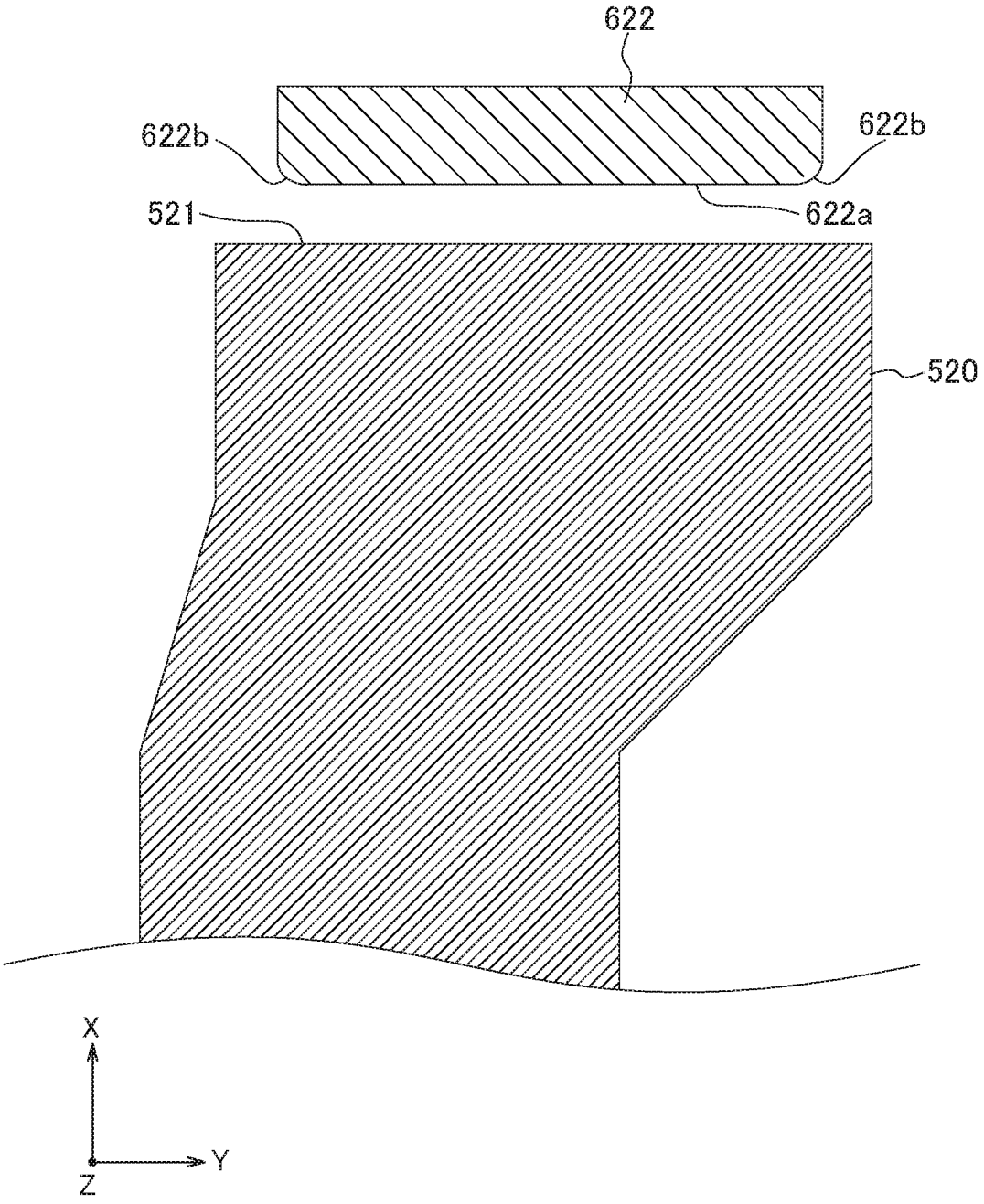
FIG. 18 is a horizontal cross-sectional view schematically showing a pressing portion of the card and a pressed portion of the movable contact portion according to the embodiment of the present invention.

In the present embodiment, the pressed portions 622*a*, 622*a* of the movable contact portion 600 are provided with radiused portions (hereinafter, referred to as "R portions") 622*b*, 622*b* at side edges brought into contact with the first pressing portion 520A and the second pressing portion 520B (edges at both ends in the Y direction) (refer to FIG. 18).

The R portions 622*b*, 622*b* avoid providing sharp edges in the regions brought into contact with (in surface contact with) the first pressing portion 520A and the second pressing portion 520B. Accordingly, the first pressing portion 520A and the second pressing portion 520B can be prevented from being chipped by the pressed portions 622*a*, 622*a*.

The R portions 622*b*, 622*b* are preferably provided at least from the lower end to the upper end of the pressed portions 622*a*, 622*a* in the vertical direction (in the Z direction).

The R portions are more preferably provided between the pressed portions 622*a*, 622*a* and the tips (the upper ends) of the branched portions 622, 622, namely, provided along the side edges (along the edges on both sides in the Y direction) from the pressed portions 622*a*, 622*a* to the upper portions of the branched portions 622, 622 above the pressed portions 622*a*, 622*a*. Such R portions can prevent the first pressing portion 520A and the second pressing portion 520B from being chipped by the side edges of the branched portions 622, 622 when the card 50 is attached to the base 200 (when the pressing portions 520 are led to the pressed portions 622*a*).

Further, in the present embodiment, the movable contact portion 600 is provided with bent portions 622*c* located above the pressed portions 622*a* and bent in a direction away from the leading portions 530 in the state in which the card 50 is put downward to be attached to the base 200.

The branched portions 622, 622 are thus provided with the bent portions 622*c*, 622*c* of which tips are located above the pressed portions 622*a*, 622*a* and bent in the direction away from the leading portions 530.

The bent portions 622*c*, 622*c* can increase a component force in the horizontal direction generated by the leading portions 530A and 530B when the card 50 is shifted downward so as to be applied to the branched portions 622, 622 (a force acting on the branched portions 622, 622 to move forward). Accordingly, the elastically-deformed portion 620 (the body portion 621 and the branched portions 622, 622) can be elastically deformed forward in the front-rear direction (in the X direction) more reliably so as to move the movable contacts 610 forward.

Alternatively, R portions protruding rearward and upward (toward the leading portions 530) may be provided in the branched portions 622, 622 above the pressed portions 622*a*, 622*a*. Namely, the front ends of the branch portions 622, 622 above the pressed portions 622*a*, 622*a* may be bent forward.

The press-fit portion 630 is provided with a press-fit projection 631. The press-fit portion 630 is press-fitted and fixed to a movable contact portion press-fit portion 223 of the base 200 so that the movable contact portion 600 is fixed to the base 200.

The movable contact portion 600 further includes movable contact-side terminal portions 640, 640 projecting downward and exposed to the outside below the housing 20 on both sides of the press-fit portion 630 in the width direction (in the Y direction). In the present embodiment, the thickness of the movable contact-side terminal portions 640, 640 (in the X direction: the thickness in the plate-thickness direction) is greater than the thickness of the elastically-deformed portion 620 (in the X direction: the thickness in the plate-thickness direction). The greater thickness increases the strength of the movable contact-side terminal portions 640, 640 while facilitating the elastic deformation of the elastically-deformed portion 620.

The thickness of the movable contact-side terminal portions 640, 640 may be increased such that part of the plate member corresponding to the respective movable contact-side terminal portions is folded over.

In the present embodiment, the movable contact portion 600 is further provided with two (plural) holes 650, 650 in the elastically-deformed portion 620 on the press-fit portion 630 side (on the bottom side) aligned along a boundary L between the elastically-deformed portion 620 and the press-fit portion 630, namely in the Y direction (in the width direction of the movable contact portion 600).

The two (plural) holes 650, 650 are elongated in the vertical direction (in the Z direction: the direction intersecting the boundary L). In the present embodiment, the two (plural) holes 650, 650 are arranged such that lower portions are located in the press-fit portion 630. The respective holes 650, 650 are thus elongated in the vertical direction across the boundary L.

The two (plural) holes 650, 650 aligned along the boundary L between the elastically-deformed portion 620 and the press-fit portion 630 can disperse a stress applied adjacent to the boundary L between the elastically-deformed portion 620 and the press-fit portion 630 when the elastically-deformed portion 620 is elastically deformed, so as to prevent plastic deformation of the movable contact portion 600.

The boundary L between the elastically-deformed portion 620 and the press-fit portion 630 cannot be defined clearly but substantially conforms to the Y direction. In the present embodiment, as illustrated in FIG. 11, a line (a virtual line) passing through a part having the greatest width in the lower region of the movable contact portion 600 below which the press-fit portion 630 is located, is defined as a virtual boundary L between the elastically-deformed portion 620 and the press-fit portion 630 for the sake of convenience. As used herein, the phrase "aligned along the boundary L between the elastically-deformed portion 620 and the press-fit portion 630" refers to a state of being aligned in the Y direction (aligned in the width direction of the movable contact portion 600).

The movable contact portion 600 having the configuration described above is fixed to the base 200 with the movable contact-side terminal portions 640, 640 exposed to the outside below the housing 20 such that the tips of the movable contact-side terminal portions 640, 640 are inserted to movable contact-side terminal insertion holes 214, 214 described below from above, and the press-fit portion 630 is press-fitted and fixed to the movable contact portion press-fit portion 223.

The movable contact-side terminal portions 640 exposed to the outside below the housing 20 are electrically connected with a target component such as a printed circuit board.

The fixed contact portion 700 includes a first fixed contact portion 710 located on the rear side of the movable contact portion 600 (toward the card 50) in the base 200 and provided with the first fixed contact 711 brought into contact with and separated from the movable contact 610 in association with the movement of the movable contact 610.

The fixed contact portion 700 also includes a second fixed contact portion 750 located on the front side of the movable contact portion 600 (on the other side of the movable contact portion 600 opposite to the card 50) in the base 200 and provided with the second fixed contact 751 brought into contact with and separated from the movable contact 610 in association with the movement of the movable contact 610.

The contact portion 60 of the present embodiment thus includes the first fixed contact portion 710, the second fixed contact portion 750, and the movable contact portion 600 located between the first fixed contact portion 710 and the second fixed contact portion 750.

When the electromagnet block 30 is switched between an excitation state and a non-excitation state so that the card 50 slides and reciprocates in the front-rear direction (in the X direction), the movable contact 610 of the movable contact portion on either side is brought into contact with the first fixed contact 711 or the second fixed contact 751.

In the present embodiment, the first fixed contact portion 710 is a normally-closed contact. The first fixed contact 711 is in contact with the movable contact 610 when the electromagnet block 30 is in a non-excitation state, and the first fixed contact 711 is separated from the movable contact 610 when the electromagnet block 30 is excited. The second fixed contact 751 is a normally-open contact. The second fixed contact portion 750 is separated from the movable contact 610 when the electromagnet block 30 is in a non-excitation state, and the second fixed contact 751 is brought into contact with the movable contact 610 when the electromagnet block 30 is excited.

Figure 12A:
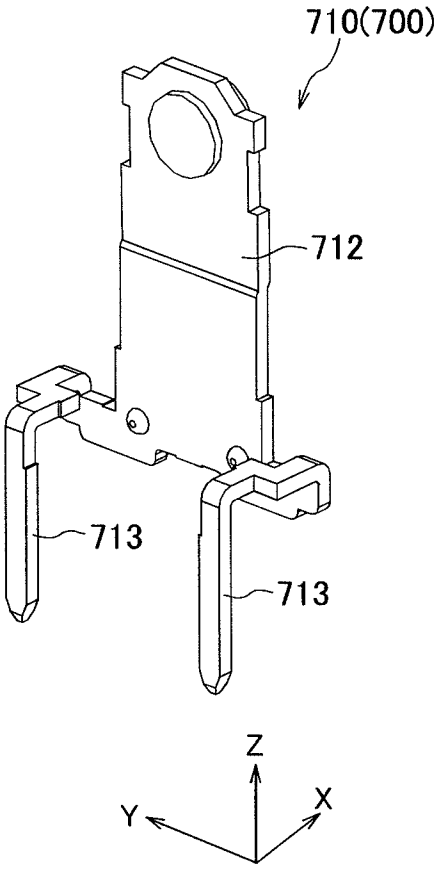
FIGS. 12A, 12B and 12C are views showing a first fixed contact portion according to the embodiment of the present invention.
Figure 12B:
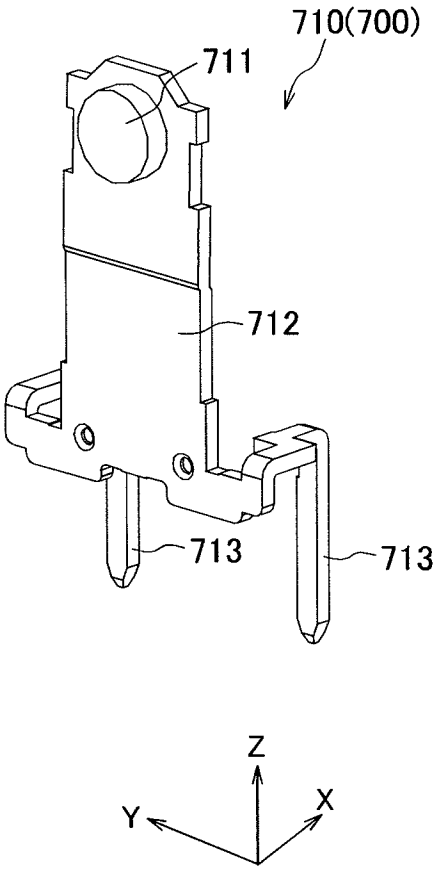
Figure 12C:
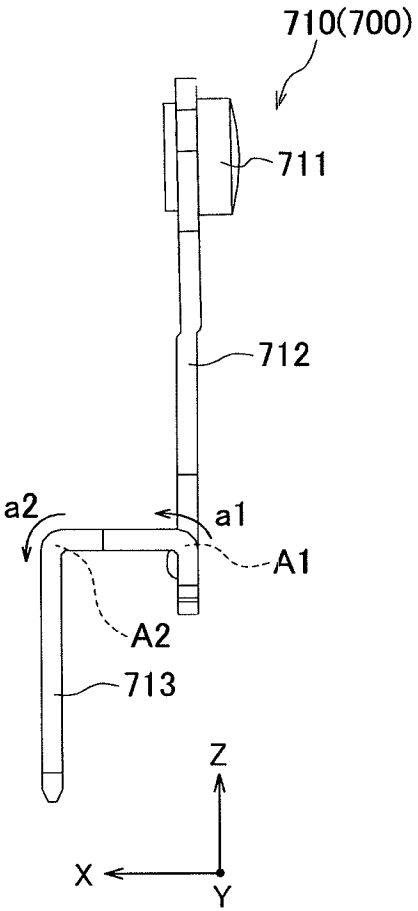

As illustrated in FIG. 12, the first fixed contact portion 710 includes a body portion 712 provided with the first fixed contact 711 and having a plate thickness and a plate width, and first fixed contact-side terminal portions (terminal portions) 713, 713 connected to the body portion 712 and extending downward. The first fixed contact portion 710 excluding the first fixed contact 711 may be made of a single metal plate bent by press molding, for example. The body portion 712 is provided with a penetration hole 712*a* at the upper portion to which the first fixed contact 711 is fixed.

The first fixed contact portion 710 is fixed to the base 200 with the first fixed contact-side terminal portions 713, 713 exposed to the outside below the housing 20 such that the tips of the first fixed contact-side terminal portions 713, 713 are inserted to first fixed contact-side terminal penetration holes 213, 213 described below from above, and the lower portion of the body portion 712 is press-fitted and fixed to a first fixed contact portion press-fit portion 221.

The first fixed contact-side terminal portions 713 exposed to the outside below the housing 20 are electrically connected with a target component such as a printed circuit board.

Figure 13A:
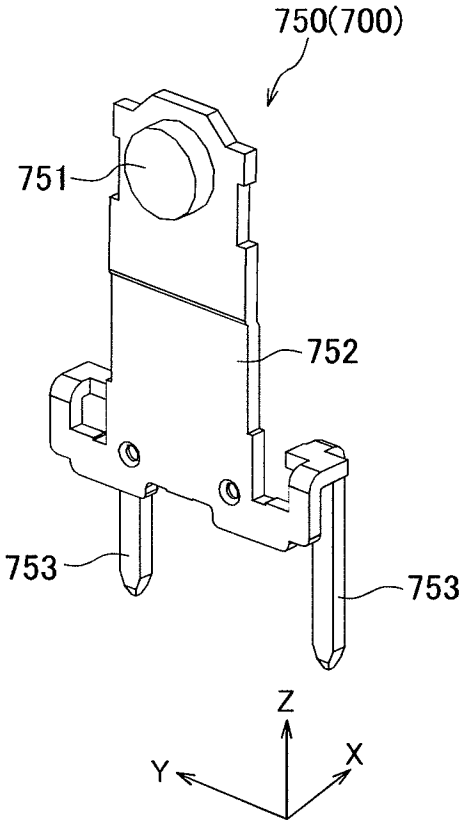
FIGS. 13A, 13B and 13C are views showing a second fixed contact portion according to the embodiment of the present invention.
Figure 13B:
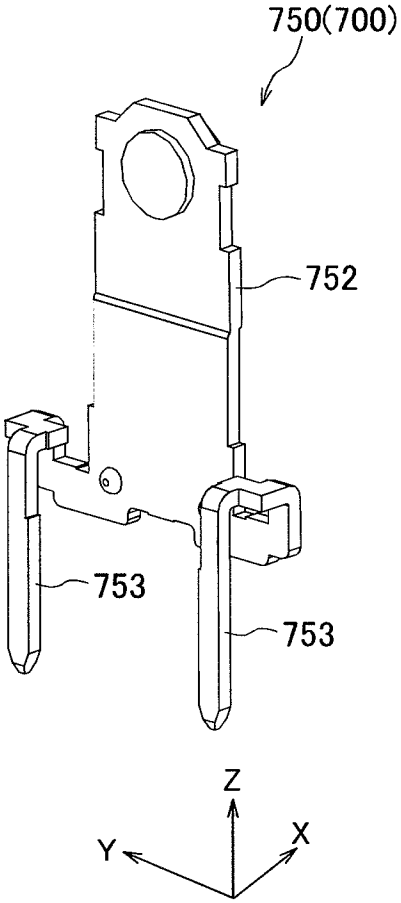
Figure 13C:
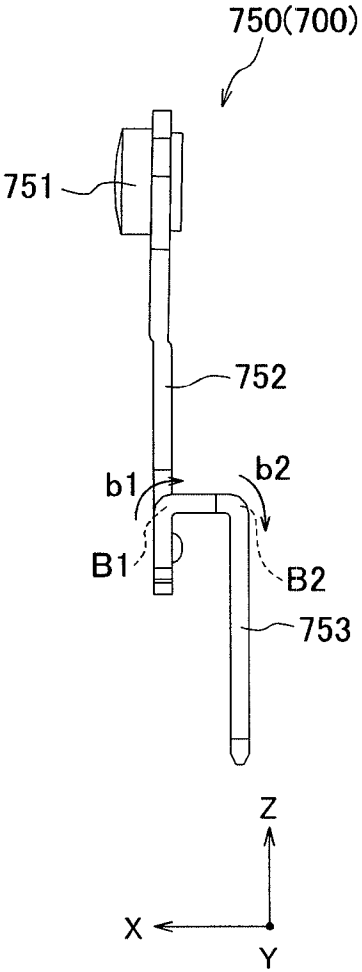

As illustrated in FIG. 13, the second fixed contact portion 750 includes a body portion 752 provided with the second contact 751 and having a plate thickness and a plate width, and second fixed contact-side terminal portions (terminal portions) 753, 753 connected to the body portion 752 and extending downward. The second fixed contact portion 750 excluding the second fixed contact 751 may also be made of a single metal plate bent by press molding, for example. The body portion 752 is provided with a penetration hole 752*a* at the upper portion to which the second fixed contact 751 is fixed.

The second fixed contact portion 750 is fixed to the base 200 with the second fixed contact-side terminal portions 753, 753 exposed to the outside below the housing 20 such that the tips of the second fixed contact-side terminal portions 753, 753 are inserted to second fixed contact-side terminal penetration holes 215, 215 described below from above, and the lower portion of the body portion 752 is press-fitted and fixed to a second fixed contact portion press-fit portion 222.

The second fixed contact-side terminal portions 753 exposed to the outside below the housing 20 are electrically connected with a target component such as a printed circuit board.

In the present embodiment, the first fixed contact portion 710 and the second fixed contact portion 750 are formed such that a fixed contact material 800 used in common is folded down.

More particularly, the plate-like fixed contact material 800 having a substantially constant thickness is folded down so as to form the body portion 712 and the first fixed contact-side terminal portions 713, 713 of the first fixed contact portion 710. Similarly, the plate-like fixed contact material 800 is folded down so as to form the body portion 752 and the second fixed contact-side terminal portions 753, 753 of the second fixed contact portion 750.

Figure 14A:
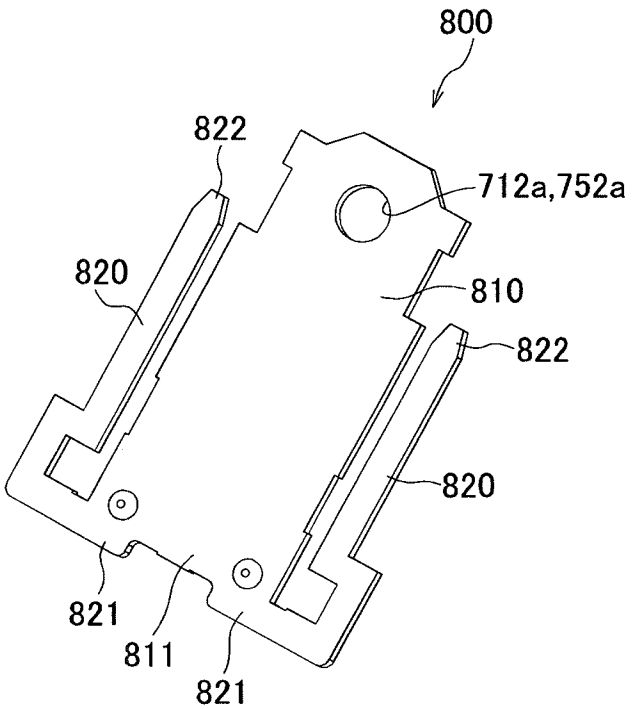
FIGS. 14A, 14B and 14C are views showing a fixed contact material according to the embodiment of the present invention.
Figure 14B:
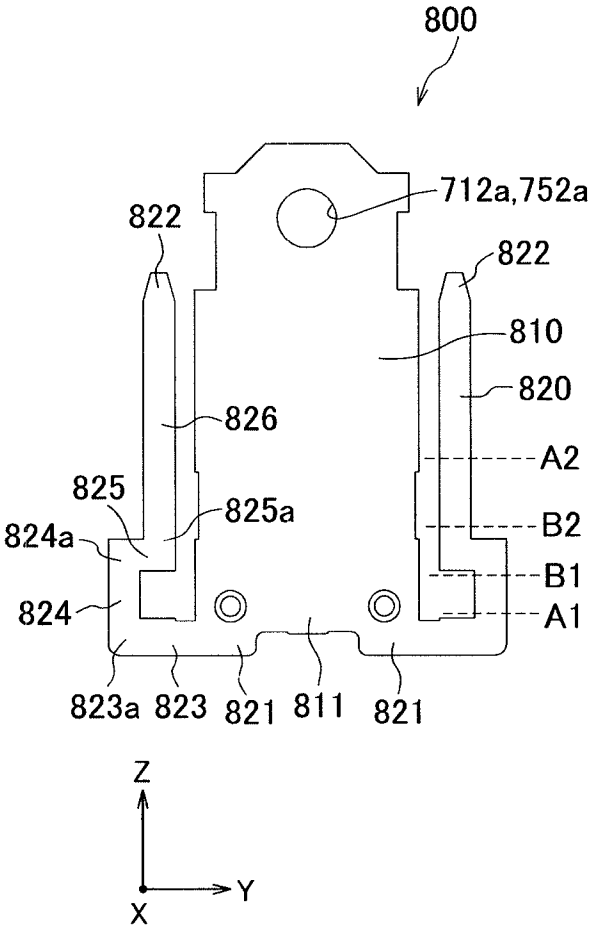
Figure 14C:
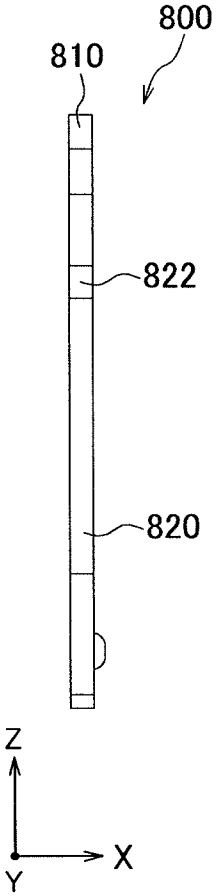

The fixed contact material 800 used for the first fixed contact portion 710 and the second fixed contact portion 750 includes a body portion pre-prepared portion 810 to serve as the body portion 712 or the body portion 752 (refer to FIG. 14). The fixed contact material 800 further includes terminal portion pre-prepared portions 820 to serve as the first fixed contact-side terminal portions 713, 713 or the second fixed contact-side terminal portions 753, 753 (refer to FIG. 14).

In the present embodiment, the terminal portion pre-prepared portions 820 include base portions 821 connected to the body portion pre-prepared portion 810 on the lower side (on one side). The terminal portion pre-prepared portions 820 also include tips 822 located above the base portions 821 on the upper side (on the other side) of the body portion pre-prepared portion 810.

The base portions 821 of the terminal portion pre-prepared portions 820 are connected to a lower edge 811 of the body portion pre-prepared portion 810. The terminal portion pre-prepared portions 820 extend outward from the body portion pre-prepared portion 810 in the width direction. The terminal portion pre-prepared portions 820 are then bent and elongated upward at both ends on the outer side in the width direction. The terminal portion pre-prepared portions 820 are each cranked on the lower side such that the portion elongated in the vertical direction is bent inward in the width direction and then bent upward.

More particularly, the terminal portion pre-prepared portions 820 each include, in addition to the base portion 821 connected to the lower edge 811 of the body portion pre-prepared portion 810, a first horizontal extension portion 823 extending outward in the width direction, a first vertical extension portion 824 extending upward from an outer end 823*a* of the first horizontal extension portion 823, a second horizontal extension portion 825 extending inward in the width direction from an upper end 824*a* of the first vertical extension portion 824, and a second vertical extension portion 826 including the tip 822 and extending upward from an inner end 825*a* of the second horizontal extension portion 825.

Each of the terminal portion pre-prepared portions 820 connected to the lower edge 811 of the body portion pre-prepared portion 810 is thus cranked to be bent upward in the middle so that the tip 822 faces upward.

The terminal portion pre-prepared portions 820 are then folded down such that the tips 822 project downward from the lower side (the one side) of the body portion pre-prepared portions 810 so as to form the fixed contact-side terminal portions 713, 713 or the second fixed contact-side terminal portions 753, 753.

In particular, the first fixed contact-side terminal portions 713, 713 are formed such that each of the terminal portion pre-prepared portions 820 is bent about 90 degrees at a first bent portion A1 and further bent about 90 degrees at a second bent portion A2 (refer to FIG. 12(*c*) and FIG. 14(*b*)). The bent direction at the first bent portion A1 conforms to the bent direction at the second bent portion A2 (as indicated by the arrows a1 and a2 in FIG. 12(*c*)). The tip 822 facing upward is therefore turned 180 degrees to face downward. The terminal portion pre-prepared portions 820 are thus bent twice in the same direction so that the tips 822 facing upward are turned to face downward and project downward below the body portion pre-prepared portion 810. Accordingly, the body portion 712 and the first fixed contact-side terminal portions 713, 713 of the first fixed contact portion 710 are obtained.

Similarly, the second fixed contact-side terminal portions 753, 753 are formed such that each of the terminal portion pre-prepared portions 820 is bent about 90 degrees at a first bent portion B1 and then bent about 90 degrees at a second bent portion B2 (refer to FIG. 13(*c*) and FIG. 14(*b*)). The bent direction at the first bent portion B1 conforms to the bent direction at the second bent portion B2 (as indicated by the arrows b1 and b2 in FIG. 13(*c*)). The tip 822 facing upward is therefore turned 180 degrees to face downward. The terminal portion pre-prepared portions 820 are thus bent twice in the same direction so that the tips 822 facing upward are turned to face downward and project downward below the body portion pre-prepared portion 810. Accordingly, the body portion 752 and the second fixed contact-side terminal portions 753, 753 of the second fixed contact portion 750 are obtained.

In the present embodiment, as described above, the first fixed contact portion 710 and the second fixed contact portion 750 are each provided with the body portion and the terminal portions formed by use of the common fixed contact material 800.

In the present embodiment, the first fixed contact portion 710 differs from the second fixed contact portion 750 in the distance from the body portion to the exposed portion of the respective terminal portions for the sake of design. The first fixed contact portion 710 therefore differs from the second fixed contact portion 750 also in the bent positions of the respective terminal portion pre-prepared portions 820. Namely, the position at the first bent portion A1 differs from the position at the first bent portion B1, and the position at the second bent portion A2 differs from the position at the second bent portion B2.

Alternatively, the first fixed contact portion 710 and the second fixed contact portion 750 may be obtained such that the respective terminal portion pre-prepared portions 820 are bent at the same positions so as to have the same distance from the body portion to the exposed portion of the respective terminal portions. The first fixed contact portion 710 and the second fixed contact portion 750 have the common shape accordingly.

The first fixed contact portion 710 and the second fixed contact portion 750 are not necessarily formed by use of the common fixed contact material 800, and fixed contact materials having corresponding shapes (different shapes) conforming to the respective first fixed contact portion 710 and second fixed contact portion 750 may be used instead.

Figure 15A:
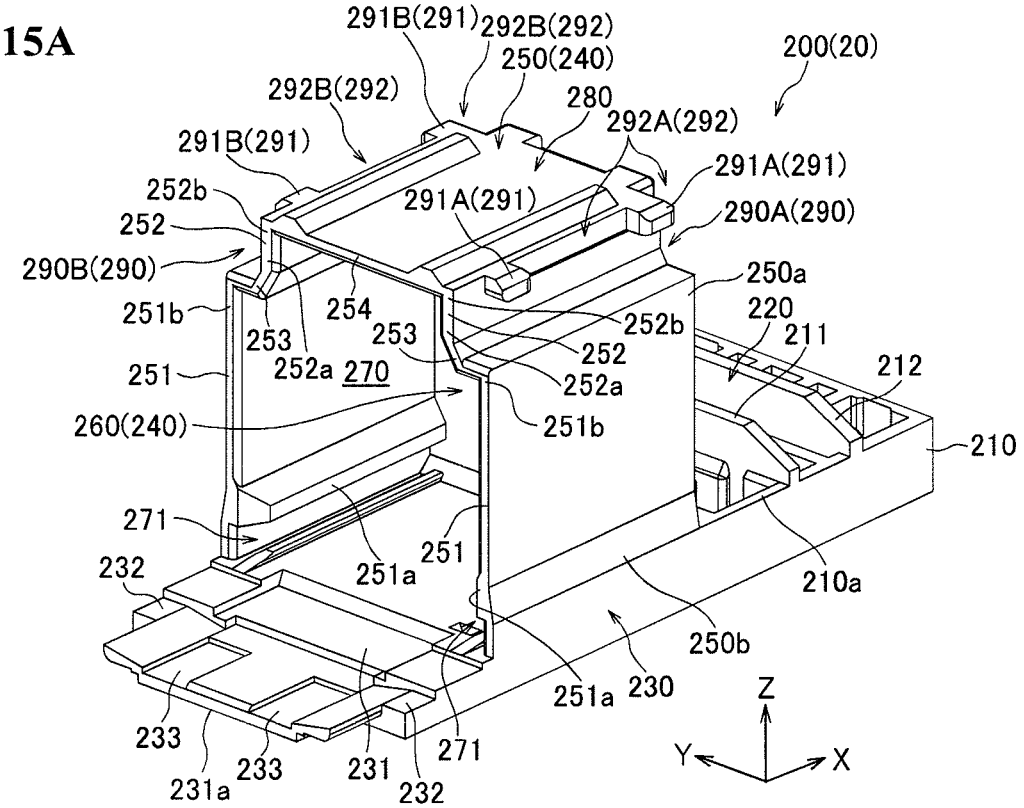
FIGS. 15A and 15B are views showing a base according to the embodiment of the present invention.
Figure 15B:
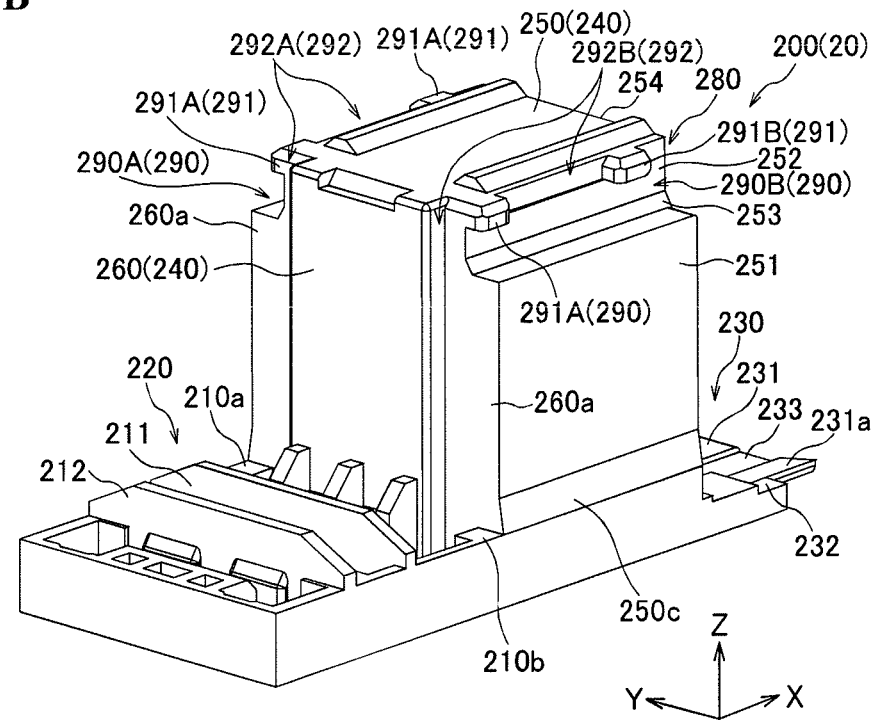
Figure 16:
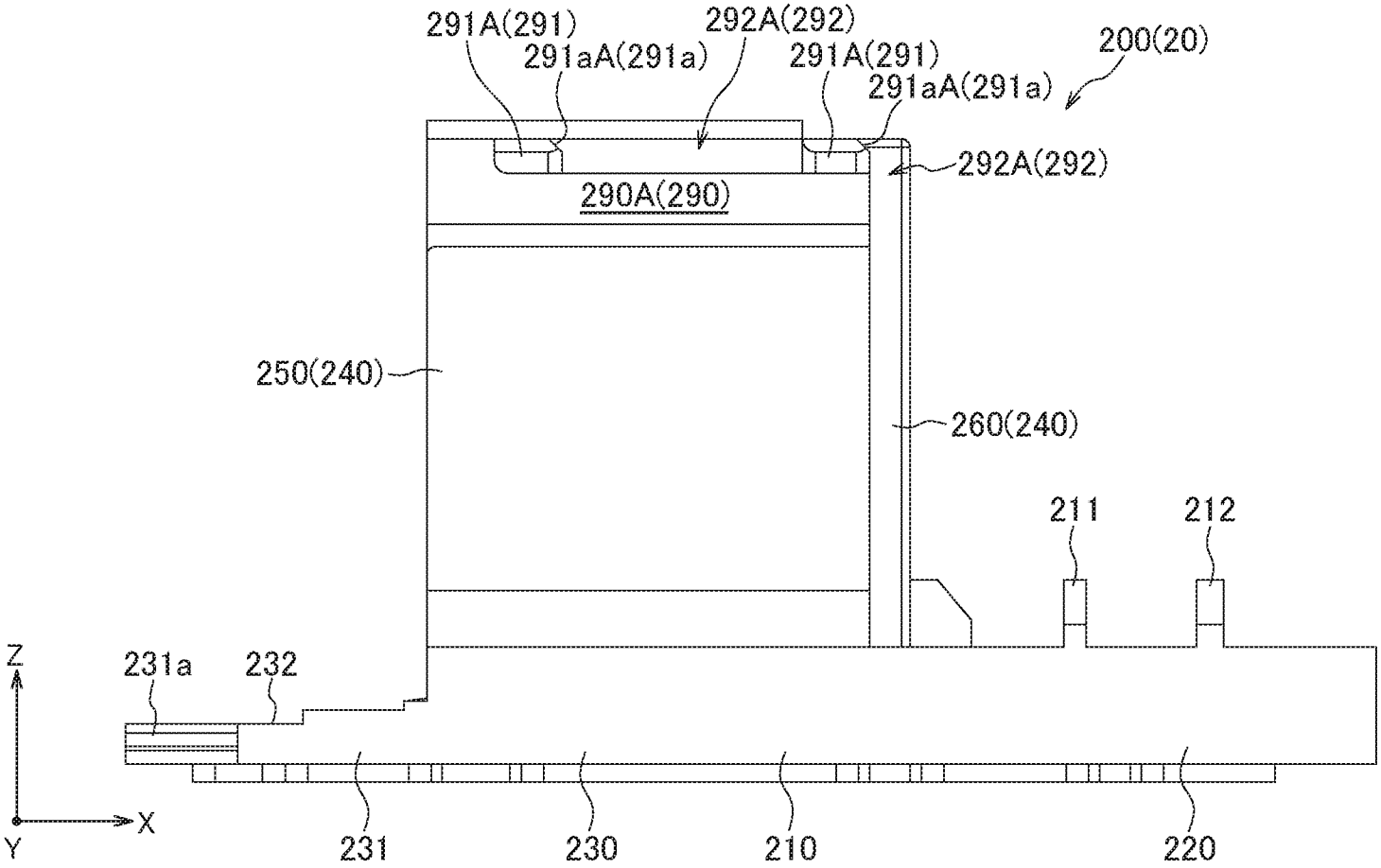
FIG. 16 is a side view of the base according to the embodiment of the present invention.
Figure 17:
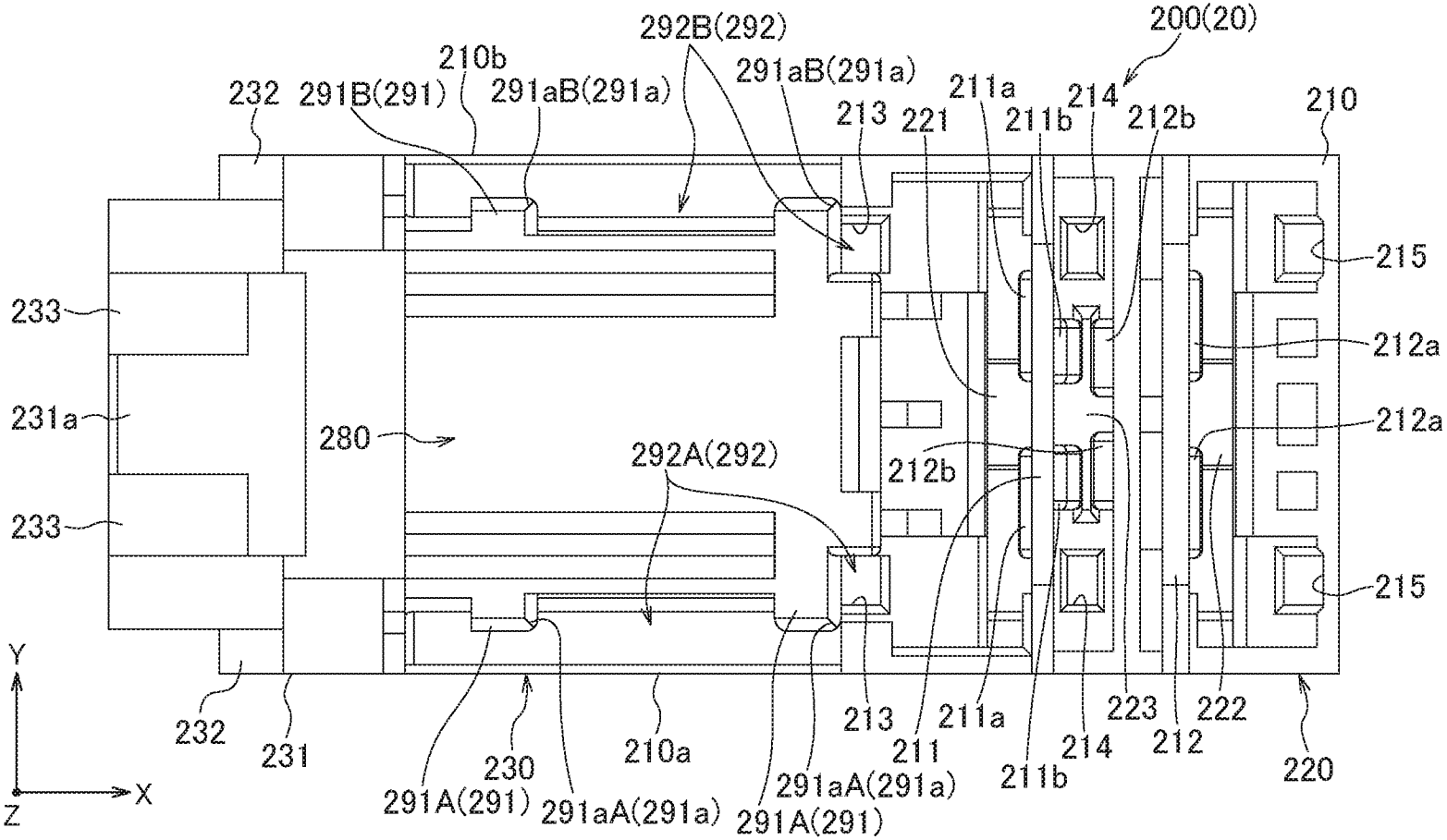
FIG. 17 is a plan view of the base according to the embodiment of the present invention.

As illustrated in FIG. 15 to FIG. 17, the base 200 includes a bottom portion 210 having a substantially rectangular shape elongated in the front-rear direction (in the X direction) to which the electromagnet block 30 and the contact portion 60 are fixed.

The bottom portion 210 of the base 200 includes an insulation wall 240 for ensuring an insulation distance between the electromagnet block 30 and the contact portion 60. In the present embodiment, the insulation wall 240 is integrated with the bottom portion 210.

The base 200 may be formed such that a synthetic resin material is molded, for example.

The bottom portion 210 of the base 200 is divided by the insulation wall 240 into a contact portion fixing portion (a contact portion arrangement region) 220 and an electromagnet block fixing portion (an electromagnet block arrangement region) 230. The contact portion fixing portion (the contact portion arrangement region) 220 is located on the front side of the bottom portion 210 in the front-rear direction (in the X direction), and the electromagnet block fixing portion (the electromagnet block arrangement region) 230 is located on the rear side of the bottom portion 210 in the front-rear direction (in the X direction).

The first fixed contact portion press-fit portion 221 to which the lower portion of the body portion 712 of the first fixed contact portion 710 is press-fitted is located on the rear side of the contact portion fixing portion (the contact portion arrangement region) 220 of the bottom portion 210 in the front-rear direction (in the X direction).

The first fixed contact-side terminal penetration holes 213, 213 to which the first fixed contact-side terminal portions 713, 713 are inserted penetrate the bottom portion 210 in the thickness direction (in the Z direction) on the rear side of the first fixed contact portion press-fit portion 221 in the front-rear direction (in the X direction) in the contact portion fixing portion (the contact portion arrangement region) 220. The first fixed contact-side terminal penetration holes 213, 213 are located on both sides of the contact portion fixing portion (the contact portion arrangement region) 220 in the width direction (in the Y direction).

The movable contact portion press-fit portion 223 to which the press-fit portion 630 of the movable contact portion 600 is press-fitted is located in the middle portion of the contact portion fixing portion (the contact portion arrangement region) 220 of the bottom portion 210 in the front-rear direction (in the X direction).

The movable contact-side terminal insertion holes 214, 214 to which the movable contact-side terminal portions 640, 640 are inserted penetrate the bottom portion 210 in the thickness direction (in the Z direction) on both sides of the movable contact portion press-fit portion 223 in the width direction (in the Y direction) in the contact portion fixing portion (the contact portion arrangement region) 220.

The second fixed contact portion press-fit portion 222 to which the lower portion of the body portion 752 of the second fixed contact portion 750 is press-fitted is located on the front side of the contact portion fixing portion (the contact portion arrangement region) 220 of the bottom portion 210 in the front-rear direction (in the X direction).

The second fixed contact-side terminal penetration holes 215, 215 to which the second fixed contact-side terminal portions 753, 753 are inserted penetrate the bottom portion 210 in the thickness direction (in the Z direction) on the front side of the second fixed contact portion press-fit portion 222 in the front-rear direction (in the X direction) in the contact portion fixing portion (the contact portion arrangement region) 220. The second fixed contact-side terminal penetration holes 215, 215 are located on both sides of the contact portion fixing portion (the contact portion arrangement region) 220 in the width direction (in the Y direction).

A partition wall 211 is elongated in the width direction (in the Y direction) and extends upward in the vertical direction (in the Z direction) in the contact portion fixing portion (the contact portion arrangement region) 220 between the first fixed contact portion 710 and the movable contact portion 600. The partition wall 211 separates the first fixed contact portion 710 from the movable contact portion 600 so as to ensure an insulation distance between the first fixed contact 711 and the movable contact 610. The partition wall 211 also prevents a short circuit of the first fixed contact portion 710 and the movable contact portion 600 or insulation deterioration of the bottom portion 210 due to chipping dust caused by the contact or separation between the first fixed contact 711 and the movable contact 610.

The partition wall 211 is provided with press-fit projections 211*a* projecting rearward in the front-rear direction (in the X direction), namely, toward the first fixed contact portion press-fit portion 221, and press-fit projections 211*b* projecting forward in the front-rear direction (in the X direction), namely, toward the movable contact portion press-fit portion 223.

A partition wall 212 is elongated in the width direction (in the Y direction) and extends upward in the vertical direction (in the Z direction) in the contact portion fixing portion (the contact portion arrangement region) 220 between the movable contact portion 600 and the second fixed contact portion 750. The partition wall 212 separates the movable contact portion 600 from the second fixed contact portion 750 so as to ensure an insulation distance between the movable contact 610 and the second fixed contact 751. The partition wall 212 also prevents a short circuit of the movable contact portion 600 and the second fixed contact portion 750 or insulation deterioration of the bottom portion 210 due to chipping dust caused by the contact or separation between the movable contact 610 and the second fixed contact 751.

The partition wall 212 is provided with press-fit projections 212*a* projecting forward in the front-rear direction (in the X direction), namely, toward the second fixed contact portion press-fit portion 222. The bottom portion 210 is provided with press-fit projections 212*b* projecting rearward in the front-rear direction (in the X direction), namely, toward the movable contact portion press-fit portion 223.

The insulation wall 240 dividing the bottom portion 210 into the contact portion fixing portion (the contact portion arrangement region) 220 and the electromagnet block fixing portion (the electromagnet block arrangement region) 230 includes a partition wall portion 260.

The partition wall portion 260 is elongated in the width direction (in the Y direction) and extends upward in the vertical direction (in the Z direction) in the bottom portion 210 between the electromagnet block 30 and the contact portion 60. In the present embodiment, the partition wall portion 260 is formed in the bottom portion 210 such that the electromagnet block 30 or the contact portion 60 does not project outward from the partition wall portion 260 as viewed in the front-rear direction (in the X direction).

In the present embodiment, as described above, the bottom portion 210 is divided by the partition wall portion 260 into the contact portion fixing portion (the contact portion arrangement region) 220 and the electromagnet block fixing portion (the electromagnet block arrangement region) 230 in the front-rear direction.

The insulation wall 240 further includes a peripheral wall portion 250 covering the electromagnet block 30 fixed to the base 200.

In the present embodiment, the peripheral wall portion 250 is elongated in the front-rear direction (in the X direction), and a front end 250*a* of the peripheral wall portion 250 is connected to a circumferential edge 260*a* of the partition wall portion 260. One end 250*b* of the peripheral wall portion 250 in the width direction (in the Y direction) is connected to a long-side portion 210*a* on one side of the bottom portion 210, and the other end 250*c* in the width direction (in the Y direction) is connected to a long-side portion 210*b* on the other side of the bottom portion 210.

Thus, the electromagnet block housing space 270 of the present embodiment open on the rear side in the front-rear direction (in the X direction) is defined by the bottom portion 210, the peripheral wall portion 250, and the partition wall portion 260. The electromagnet block 30 is fixed to the base 200 such that the electromagnet block 30 is introduced from the rear side to the front side in the front-rear direction (in the X direction) (to make a parallel movement) so as to be housed in the electromagnet block housing space 270.

In the present embodiment, the peripheral wall portion 250 is provided only on the front side of the electromagnet block fixing portion (the electromagnet block arrangement region) 230 in the front-rear direction (in the X direction). The electromagnet block fixing portion (the electromagnet block arrangement region) 230 on the rear side in the front-rear direction (in the X direction) is provided with a rear-side projection 231 projecting rearward from the peripheral wall portion 250 in the front-rear direction (in the X direction).

The rear-side projection 231 includes the mount portions 232, 232 on which the setting blocks 323, 323 are mounted, and the held portion 231*a* held between the holding pieces 323*b*, 323*b* provided on the setting blocks 323, 323.

The held portion 231*a* is provided with clearance grooves 233, 233 for avoiding obstructing the spring portion 362.

The peripheral wall portion 250 includes first side walls (lower side walls) 251, 251 connected to the respective long-side portions 210*a* and 210*b* of the bottom portion 210, and elongated in the front-rear direction (in the X direction) and extending upward in the vertical direction (in the Z direction) from the respective long-side portions 210*a* and 210*b*. The peripheral wall portion 250 further includes second side walls (upper side walls) 252, 252 located on the inner side of the first side walls (lower side walls) 251, 251 in the width direction (in the Y direction) and extending upward in the vertical direction (in the Z direction).

The peripheral wall portion 250 further includes connection walls 253, 253 connecting upper ends 251*b*, 251*b* of the first side walls (lower side walls) 251, 251 and lower ends 252*a*, 252*a* of the second side walls (upper side walls) 252, 252, and a top wall 254 connecting upper ends 252*b*, 252*b* of the respective second side walls (upper side walls) 252, 252.

In the present embodiment, the connection walls 253, 253 have a shape bent inward in the width direction (in the Y direction).

The first side walls (lower side walls) 251, 251 are provided with elongated projections 251*a*, 251*a* projecting inward in the width direction (in the Y direction) at the lower portions on the inner side in the width direction (in the Y direction). The engagement grooves 271, 271 in which the elongated engagement projections 352*b*, 352*b* are inserted are provided between the elongated projections 251*a*, 251*a* and the bottom portion 210.

In the present embodiment, the peripheral wall portion 250 is thus defined by the first side walls (lower side walls)

251, 251, the second side walls (upper side walls) 252, 252, the connection walls 253, 253, and the top wall 254. The partition wall portion 260 has an outer circumferential shape (an outline as viewed in the front-rear direction) which conforms to an outer circumferential shape (an outline as viewed in the front-rear direction) of the peripheral wall portion 250.

In the present embodiment, the card holding portion 280 to which the card 50 is held is provided at the upper portion of the insulation wall 240.

The card holding portion 280 in the insulation wall 240 is introduced into the penetration hole 580 of the card 50 as described above when the card 50 is fixed to the base 200.

The card holding portion 280 includes the rail portions 290 for guiding the card 50 upon sliding. In the present embodiment, the rail portions 290 are located on the upper side of the peripheral wall portion 250 (on the opposite side of the bottom portion 210).

The rail portions 290 are elongated in the front-rear direction (in the X direction) and defined by the second side walls (upper side walls) 252, 252 and the connection walls 253, 253, and open upward in the vertical direction (in the Z direction) and outward in the width direction (in the Y direction).

The rail portions 290 include the first rail portion 290A and the second rail portion 290B elongated substantially in parallel to each other.

In the present embodiment, the rail portions 290 are provided with stopper portions 291 so as to hold the card 50 to the card holding portion 280 more reliably.

The stopper portions 291 have a function of preventing the slide portions 511 from being disengaged from the rail portions 290.

In the present embodiment, the stopper portions 291 prevent disengagement of the slide portions 511 from the rail portions 290 particularly when the card 50 held to the card holding portion 280 slides and reciprocates along the rail portions 290.

The stopper portions 291 prevent the disengagement of the slide portions 511 from the rail portions 290 wherever the card 50 is located between one end and the other end in the reciprocating range upon sliding.

As used herein, the position at one end during the reciprocating slide of the card 50 refers to a front-most position in the front-rear direction (in the X direction) at which the card 50 is located when the electromagnetic relay 1 is assembled and the electromagnet block 30 is excited so that the card 50 slides forward. The position at the other end refers to a back-most position in the front-rear direction (in the X direction) at which the card 50 is located when the electromagnetic relay 1 is assembled and the electromagnet block 30 is shifted to a non-excitation state so that the card 50 slides rearward.

In the present embodiment, the stopper portions 291 project outward in the width direction (in the Y direction) on the upper side of the rail portions 290, and are located above the slide portions 511 in the state in which the card 50 is held to the card holding portion 280.

Each rail portion 290 includes two (plural) stopper portions 291, 291 aligned in the front-rear direction (in the X direction: the extending direction of the rail portions 290).

Each rail portion 290 is provided, between the aligned stopper portions 291, 291, with a space 292 for allowing the slide portion 511 to pass through. In the present embodiment, another space 292 through which the slide portion 511 passes is also provided in front of the stopper portion 291 located on the front side.

The card 50 is held to the card holding portion 280 in the following manner so as to prevent the disengagement of the slide portions 511 by the stopper portions 291.

First, the card 50 is put downward in the vertical direction (in the Z direction: the direction intersecting the extending direction of the rail portions 290) so that the slide portions 511 are introduced to the rail portions 290 through the spaces 292.

The card 50 is then moved to the rear side in the front rear direction (in the X direction: the extending direction of the rail portions 290) in the state in which the slide portions 511 are introduced to the rail portions 290. The card 50 is moved until the slide portions 511 and the stopper portions 291 at least partly overlap with each other as viewed in the vertical direction (in the Z direction: the direction intersecting the extending direction of the rail portions 290).

The card 50 is thus slidably held to the card holding portion 280 (the base 200) to reciprocate while the stopper portions 291 prevent the disengagement of the slide portions 511.

In the present embodiment, at least one of the slide portions 511 and the stopper portions 291 for preventing the disengagement of the slide portions 511 from the rail portions 290, which is the stopper portions 291 in this case, is provided with a tapered portion 291*a*. In particular, the tapered portion 291*a* inclined downward and forward is provided at a front upper portion of the respective stopper portions 291 which may come into contact with the slide portion 511 when the card 50 is held to the card holding portion 280. A radiused portion (R portion) may be provided at the front upper portion of the stopper portion 291 instead. Alternatively, the slide portions 511 may be provided with a tapered portion or R portion at a rear bottom portion.

The tapered portion or R portion provided in at least one of the slide portions 511 and the stopper portions 291 for preventing the disengagement of the slide portions 511 from the rail portions 290 facilitates the fixation of the card 50 to the base 200 more smoothly. The tapered portion or R portion can avoid generation of dust caused by the contact between the slide portions 511 and the stopper portions 291 to cause scratches on the card 50 when the card 50 is fixed to the base 200.

In the present embodiment, the stopper portions 291 include first stopper portions 291A provided in the first rail portion 290A to prevent disengagement of the first slide portions 511A from the first rail portion 290A.

The stopper portions 291 also include second stopper portions 291B provided in the second rail portion 290B to prevent disengagement of the second slide portions 511B from the second rail portion 290B.

The two (plural) first stopper portions 291A, 291A are aligned in the front rear direction (in the X direction: the extending direction of the first rail portion 290A) in the first rail portion 290A. The first rail portion 290A is provided with a first space 292A for allowing the first slide portion 511A to pass through is provided between the aligned first stopper portions 291A, 291A. In the present embodiment, another first space 292A through which the first slide portion 511A passes is also provided in front of the first stopper portion 291A located on the front side.

The two (plural) second stopper portions 291B, 291B are aligned in the front rear direction (in the X direction: the extending direction of the second rail portion 290B) in the second rail portion 290B. The second rail portion 290B is provided with a second space 292B for allowing the second slide portion 511B to pass through is provided between the aligned second stopper portions 291B, 291B. In the present embodiment, another second space 292B through which the second slide portion 511B passes is also provided in front of the second stopper portion 291B located on the front side.

One of the two (plural) first stopper portions 291A (the first stopper portion 291A on the front side) prevents one of the two (plural) first slide portions 511A (the first slide portion 511A on the front side) from being disengaged from the first rail portion 290A.

The other one of the two (plural) first stopper portions 291A (the first stopper portion 291A on the rear side) prevents the other one of the two (plural) first slide portions 511A (the first slide portion 511A on the rear side) from being disengaged from the first rail portion 290A.

One of the two (plural) second stopper portions 291B (the second stopper portion 291B on the front side) prevents one of the two (plural) second slide portions 511B (the second slide portion 511B on the front side) from being disengaged from the second rail portion 290B.

The other one of the two (plural) second stopper portions 291B (the second stopper portion 291B on the rear side) prevents the other one of the two (plural) second slide portions 511B (the second slide portion 511B on the rear side) from being disengaged from the second rail portion 290B.

In the present embodiment, as described above, the four slide portions 511 are arranged on the front and rear sides and the right and left sides in the card 50 having a substantially frame-like shape, and the four stopper portions 291 are arranged on the front and rear sides and the right and left sides in the card holding portion 280. When the card 50 is fixed to the card holding portion 280, the four stopper portions 291 provided in the card holding portion 280 are respectively opposed to the four slide portions 511, so as to prevent the disengagement of the respective slide portions 511 by the respective stopper portions 291.

The four stopper portions 291 are each provided with the tapered portion 291*a* as described above.

In particular, a tapered portion 291*a*A inclined downward and forward is provided at the front upper portion of each of the two first stopper portions 291A which may come into contact with the respective first slide portions 511A when the card 50 is held to the card holding portion 280. Similarly, a tapered portion 291*a*B inclined downward and forward is provided at the front upper portion of each of the two second stopper portions 291B which may come into contact with the respective second slide portions 511B when the card 50 is held to the card holding portion 280.

Next, a method of assembling the electromagnetic relay 1 having the configuration as described above is illustrated below.

Figure 20:
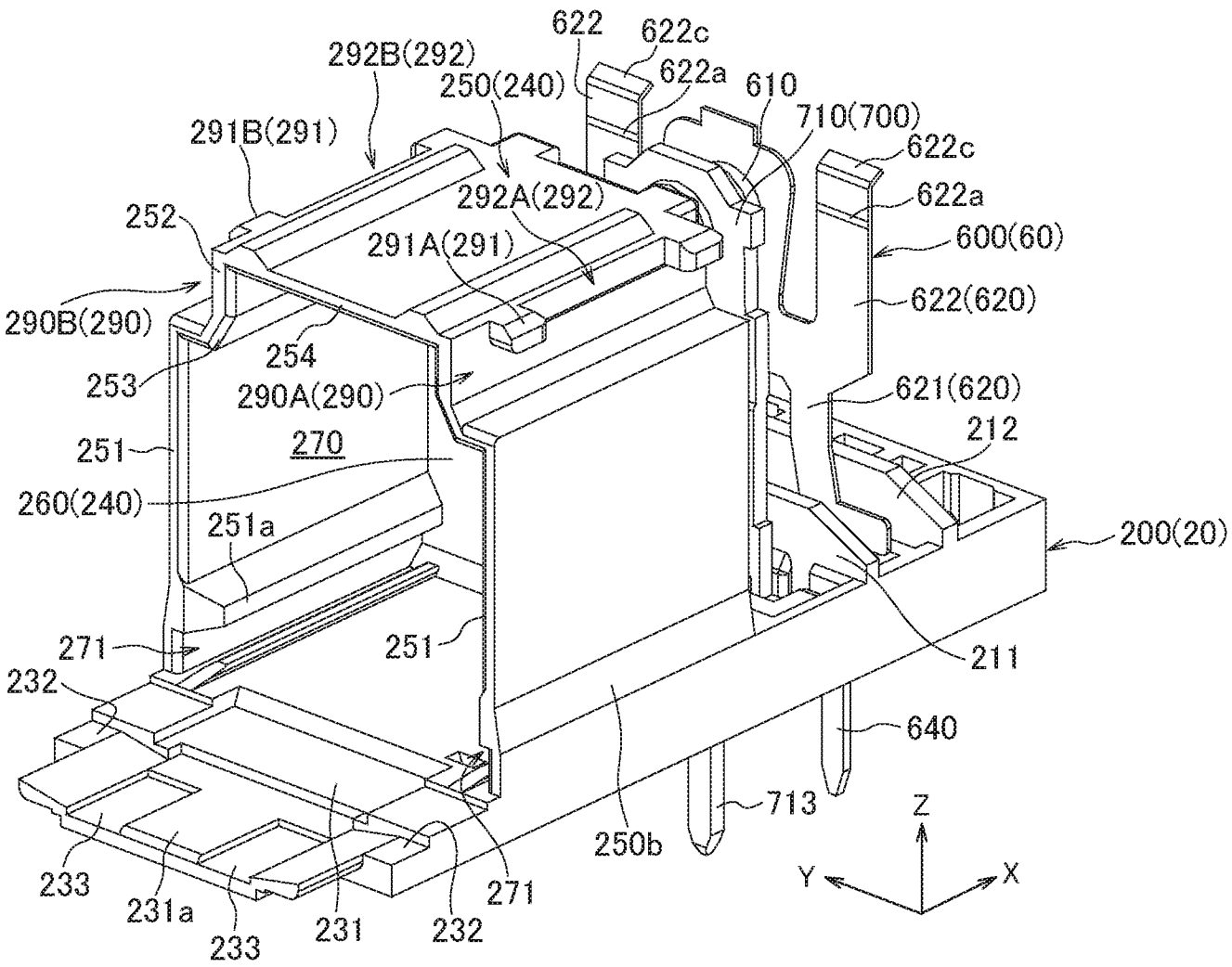
FIG. 20 is a perspective view showing a state in which the movable contact portion and the first fixed contact portion are fixed to the base according to the embodiment of the present invention.

The first fixed contact portion 710 is fixed to the contact portion fixing portion (the contact portion arrangement region) 220 of the base 200 such that the first fixed contact portion 710 is put and moved downward from above in a state in which the tips of the first fixed contact-side terminal portions 713, 713 face downward (refer to FIG. 20).

In particular, the tips of the first fixed contact-side terminal portions 713, 713 are inserted to the first fixed contact-side terminal penetration holes 213, 213 of the base 200 from above, and the lower portion of the body portion 712 is press-fitted from above and fixed to the first fixed contact portion press-fit portion 221.

The first fixed contact portion 710 is thus fixed to the contact portion fixing portion (the contact portion arrangement region) 220 of the base 200 while the first fixed contact-side terminal portions 713, 713 are exposed to the outside below the housing 20.

The movable contact portion 600 is fixed to the contact portion fixing portion (the contact portion arrangement region) 220 of the base 200 such that the movable contact portion 600 is put and moved downward from above in a state in which the tips of the movable contact-side terminal portions 640, 640 face downward (refer to FIG. 20).

In particular, the tips of the movable contact-side terminal portions 640, 640 are inserted to the movable contact-side terminal insertion holes 214, 214 of the base 200 from above, and the press-fit portion 630 is press-fitted from above and fixed to the movable contact portion press-fit portion 223.

The movable contact portion 600 is thus fixed to the contact portion fixing portion (the contact portion arrangement region) 220 of the base 200 while the movable contact-side terminal portions 640, 640 are exposed to the outside below the housing 20.

The movable contact portion 600 may be fixed to the base 200 before the first fixed contact portion 710 is fixed to the base 200, or the both operations may be performed simultaneously.

Figure 21:
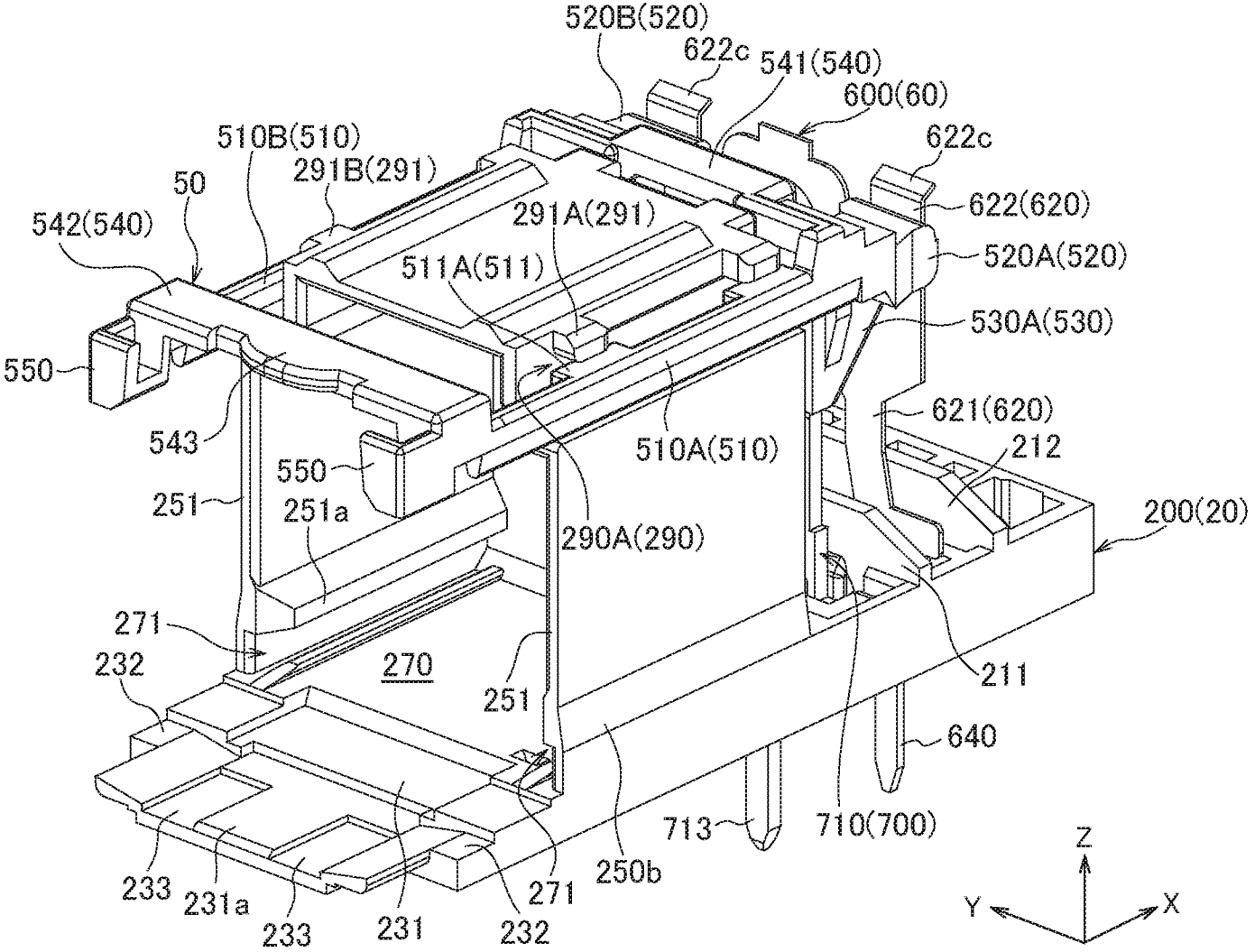
FIG. 21 is a perspective view showing a state in which the card is fixed to the base shown in FIG. 20.

The card 50 is then put and moved downward from above to be fixed to the card holding portion 280 of the base 200 (refer to FIG. 21).

Figure 22:
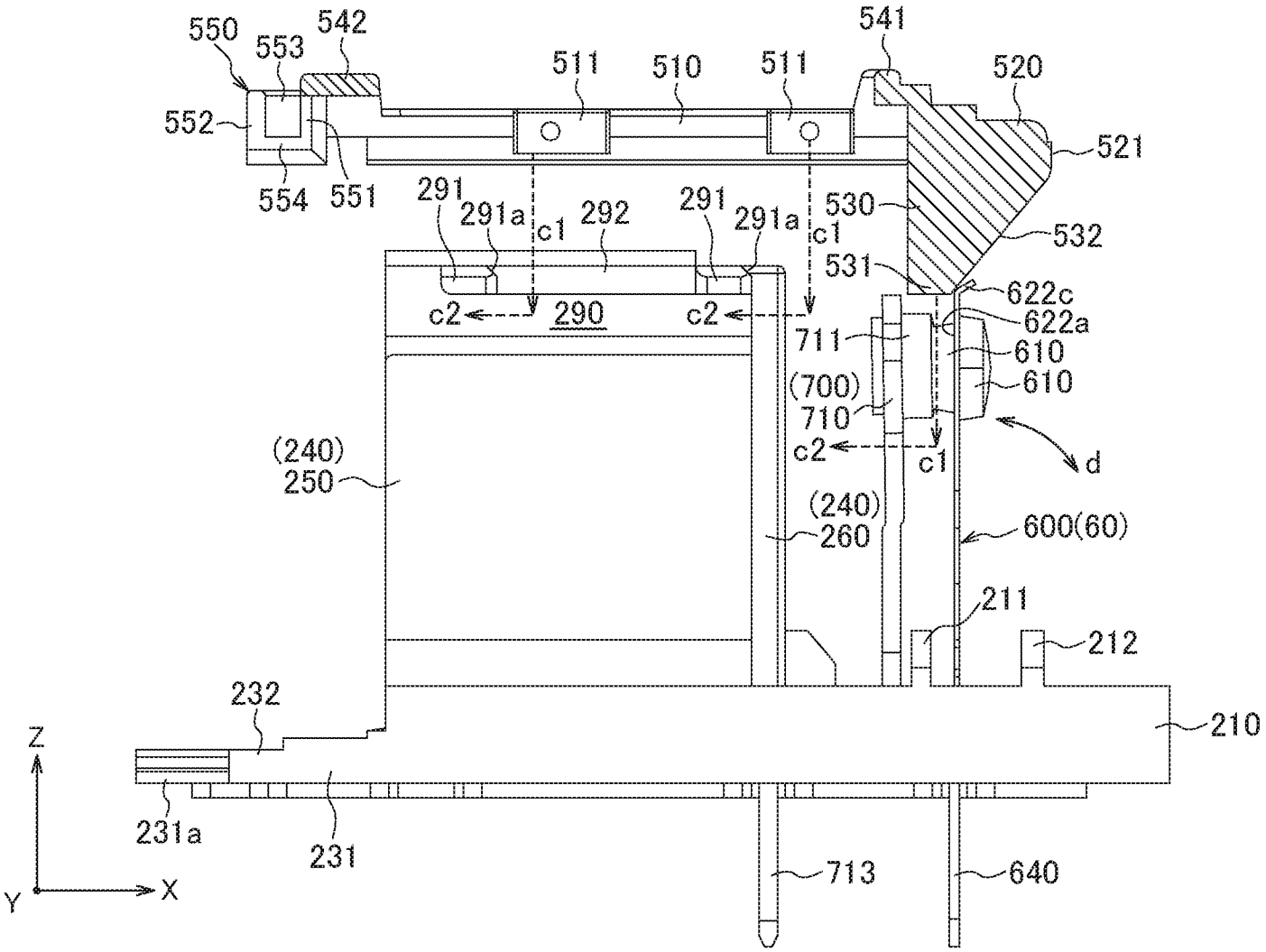
FIG. 22 is a view for explaining a state in which a leading portion presses the movable contact portion when the card is fixed to the base shown in FIG. 20.

In particular, in a state in which the base 200 is placed such that the card holding portion 280 faces upward, the card 50 is positioned above the card holding portion 280 (refer to FIG. 22).

The first slide portion 511A on the front side is opposed in the vertical direction (in the Z direction) to the first space 292A in front of the first stopper portion 291A provided on the front side.

The second slide portion 511B on the front side is opposed in the vertical direction (in the Z direction) to the second space 292B in front of the second stopper portion 291B provided on the front side.

The first slide portion 511A on the rear side is opposed in the vertical direction (in the Z direction) to the first space 292A provided between the two first stopper portions 291A.

The second slide portion 511B on the rear side is opposed in the vertical direction (in the Z direction) to the second space 292B provided between the two second stopper portions 291B.

The respective tips 531 of the leading portions 530 are opposed to the respective bent portions 622*c* of the branched portions 622 in the vertical direction (in the Z direction).

The card 50 positioned as described above is moved downward in parallel to the vertical direction (the Z direction) (as indicated by the arrow c1 in FIG. 22).

The respective tips 531 of the leading portions 530 are then brought into contact with the respective bent portions 622*c* of the branched portions 622, so that the elastically-deformed portion 620 (the body portion 621 and the branched portions 622, 622) is elastically deformed to move forward in the front-rear direction (in the X direction) (as indicated by the arrow d in FIG. 22).

The elastically-deformed portion 620 (the body portion 621 and the branched portions 622, 622) is pressed by the leading portions 530 and elastically deformed (moves) forward in the front-rear direction (in the X direction) more greatly as the card 50 is gradually shifted downward in the vertical direction (in the Z direction).

The parallel movement of the card 50 to the lower side in the vertical direction (in the Z direction) is kept until the four slide portions 511 are housed in the rail portions 290 via the spaces 292, so that the pressing portions 520 are led to the pressed portions 622*a* of the movable contact portion 600.

Namely, the pressing portions 520 are brought into contact with the pressed portions 622*a* on the rear side in the front-rear direction (in the X direction).

In the state in which the four slide portions 511 are housed in the rail portions 290, the card 50 is moved (to slide) rearward in parallel to the front-rear direction (the X direction) (as indicated by the arrow c2 in FIG. 22). The parallel movement (slide) of the card 50 to the rear side in the front-rear direction (in the X direction) may be made by use of a force of restitution of the elastically-deformed portion 620 (the body portion 621 and the branched portions 622, 622) (as indicated by the arrow d in FIG. 22).

The card 50 is continuously moved (to slide) rearward in the front-rear direction (in the X direction) until the slide portions 511 and the stopper portions 291 at least partly overlap with each other as viewed in the vertical direction (in the Z direction: the direction intersecting the extending direction of the rail portions 290).

The card 50 is thus slidably held to the card holding portion 280 (the base 200) to reciprocate in the state in which the disengagement of the slide portions 511 is prevented by the stopper portions 291.

In the present embodiment, when the card 50 is moved (to slide) rearward in the front-rear direction (in the X direction), the rear end of the first connection piece (the first connection portion) 541 and the rear end of the leading portions 530 are brought into contact with the front surface of the partition wall 260, so as to regulate the further rearward movement.

Figure 23:
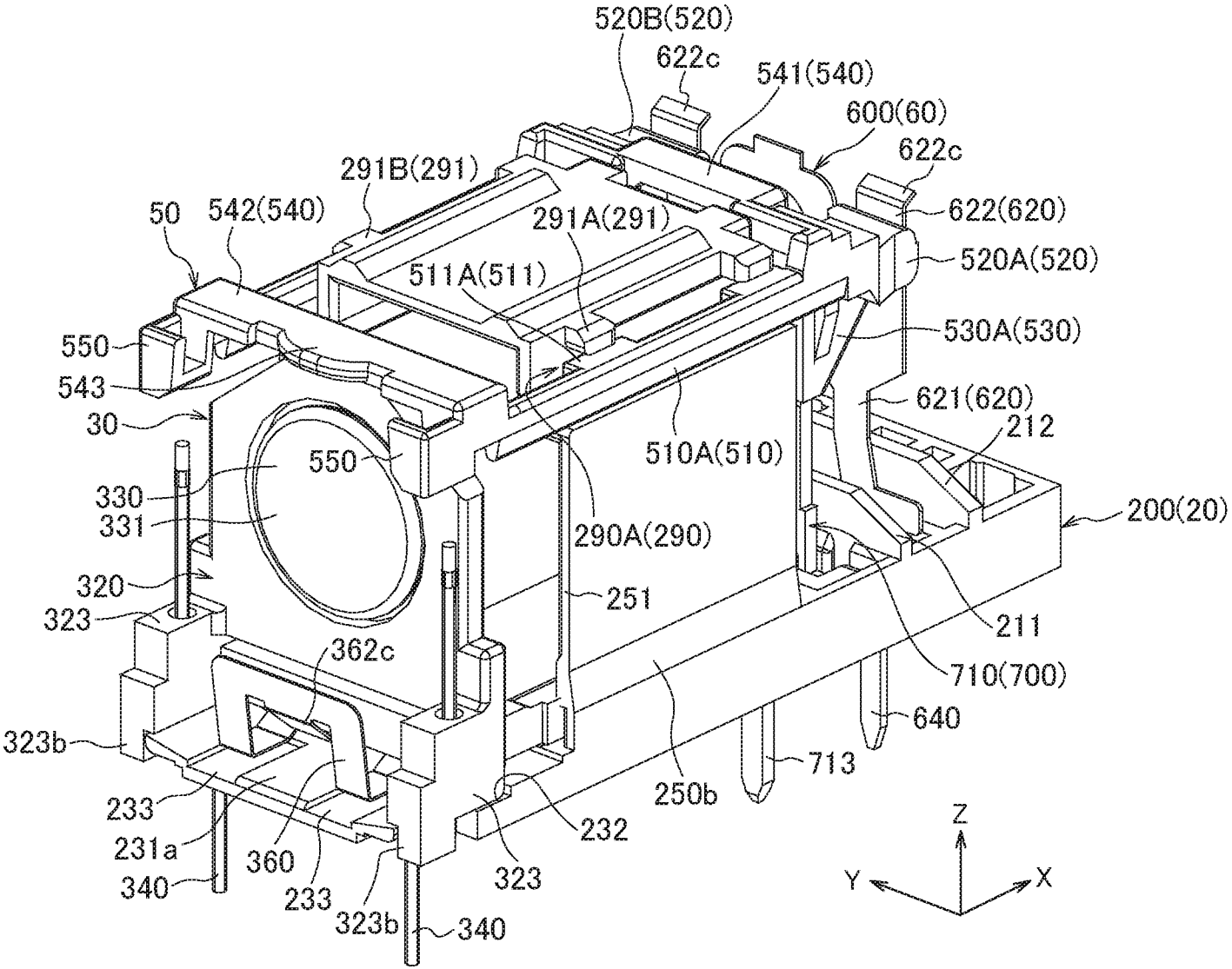
FIG. 23 is a perspective view showing a state in which the electromagnet block is fixed to the base shown in FIG. 21.

Subsequently, the electromagnet block 30 preliminarily assembled in a separate process is put and moved forward in parallel to the front-rear direction (in the X direction) so as to be fixed to the electromagnet block fixing portion (the electromagnet block arrangement region) 230 of the base 200 (refer to FIG. 23).

In particular, the electromagnet block 30 is opposed to the opening of the electromagnet block housing space 270 in a state in which the lateral wall portion 352 of the yoke 350 is located on the lower side, and the spring portion 362 of the hinge spring 360 faces rearward.

The electromagnet block 30 is then housed in the electromagnet block housing space 270 while the elongated engagement projections 352*b*, 352*b* provided on both sides of the lateral wall portion 352 in the width direction (in the Y direction) are inserted to the engagement grooves 271, 271. The electromagnet block 30 is thus fixed to the base 200 in a state in which the elongated engagement projections 352*b*, 352*b* are engaged with the engagement grooves 271, 271, the held portion 231*a* is held between the pair of the holding pieces 323*b*, 323*b*, and the setting blocks 323, 323 are mounted on mount portions 232, 232.

The electromagnet block 30 may be fixed to the base 200 before the card 50 is fixed to the base 200, or the both operations may be performed simultaneously. The electromagnet block 30 may be fixed to the base 200 before the first fixed contact portion 710 is fixed to the base 200 or before the movable contact portion 600 is fixed to the base 200.

The electromagnet block 30 is not necessarily preliminarily assembled. The electromagnet block 30 may be assembled in parallel with the fixation of the first fixed contact portion 710, the movable contact portion 600 and the card 50 to the base 200.

Figure 24:
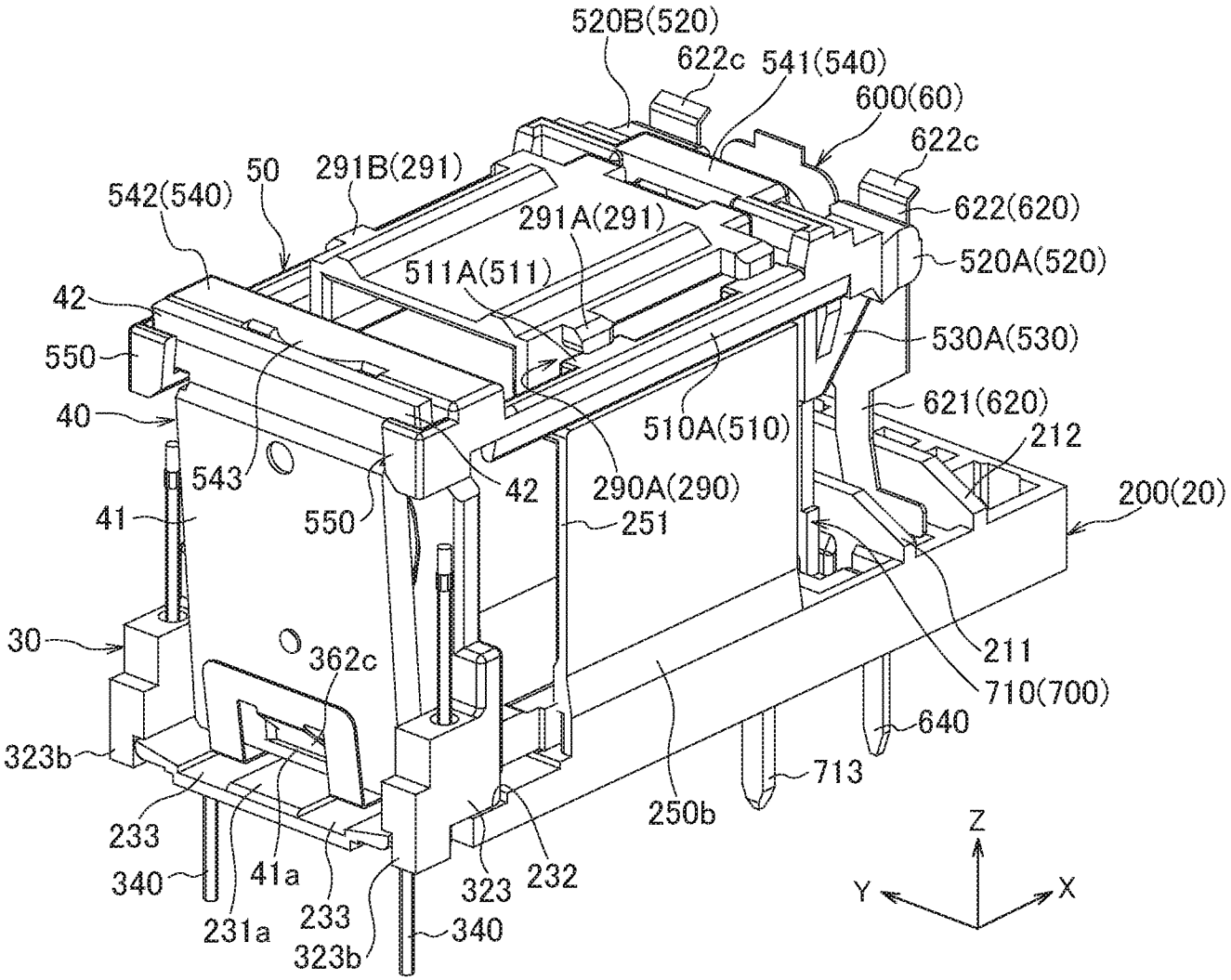
FIG. 24 is a perspective view showing a state in which the armature is fixed to the electromagnet block while the armature is mounted on the card shown in FIG. 23.

The pair of the projections 42 of the armature 40 is then mounted on the mount portions 550, and the fixing piece 362*c* of the spring portion 362 is engaged with the engagement recess 41*a* of the armature 40, so that the card 50 slides in association with the movement of the armature body 41 (refer to FIG. 24).

In particular, the armature 40 is positioned above the card 50 in a state in which the pair of the projections 42 is located on the upper side and the opening of the engagement recess 41*a* faces rearward, and the armature 40 is then put and moved downward in parallel to the vertical direction (in the Z direction).

The pair of the projections 42 are mounted on the mount portions 550, 550 from above while the armature body 41 is inserted through the space 560, and the fixing piece 362*c* of the spring portion 362 is engaged with the engagement recess 41*a* of the armature 40. The armature 40 is thus set to be movable together with the card 50.

Figure 25:
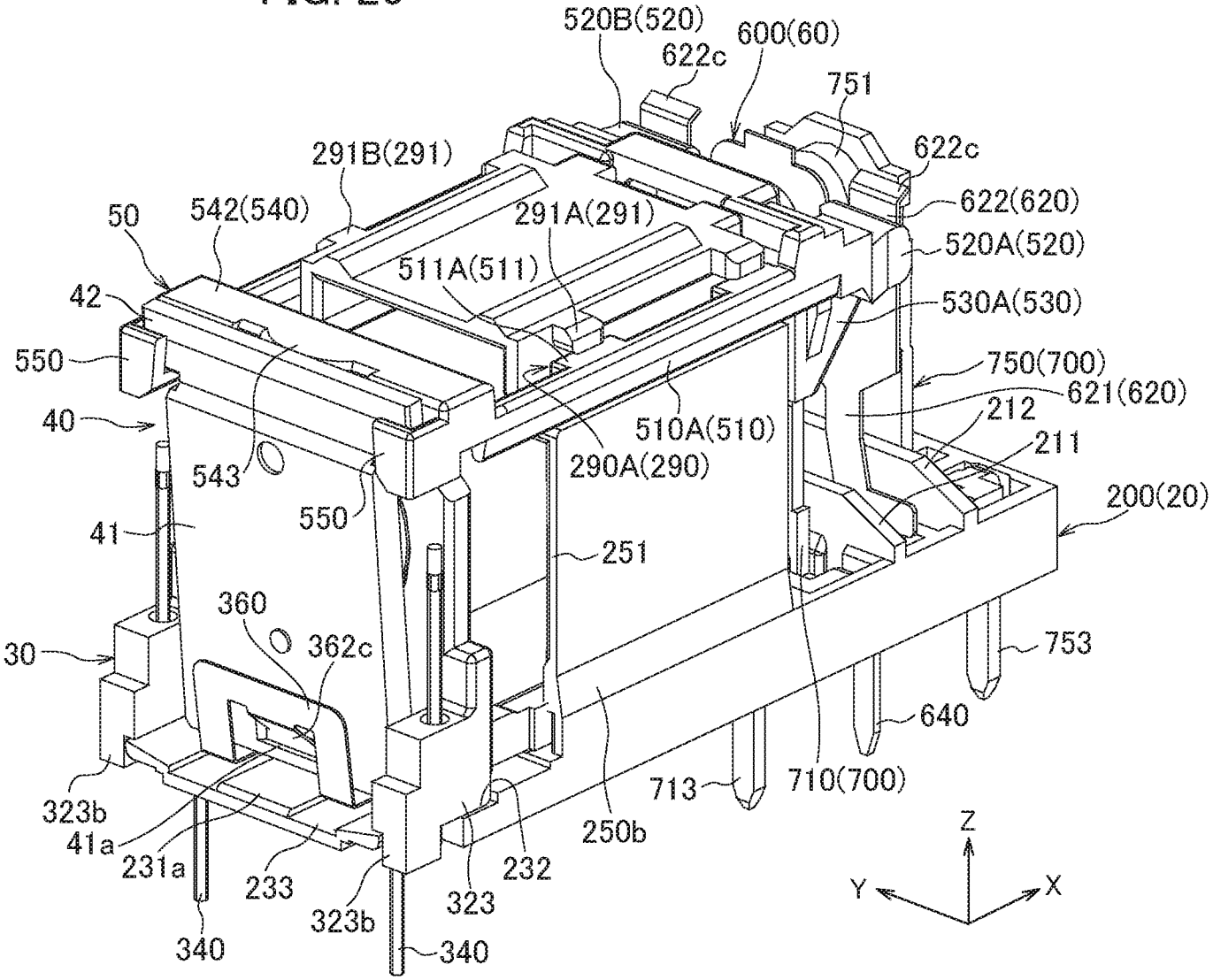
FIG. 25 is a perspective view showing a state in which the second fixed contact portion is fixed to the base shown in FIG. 24.
Figure 26:
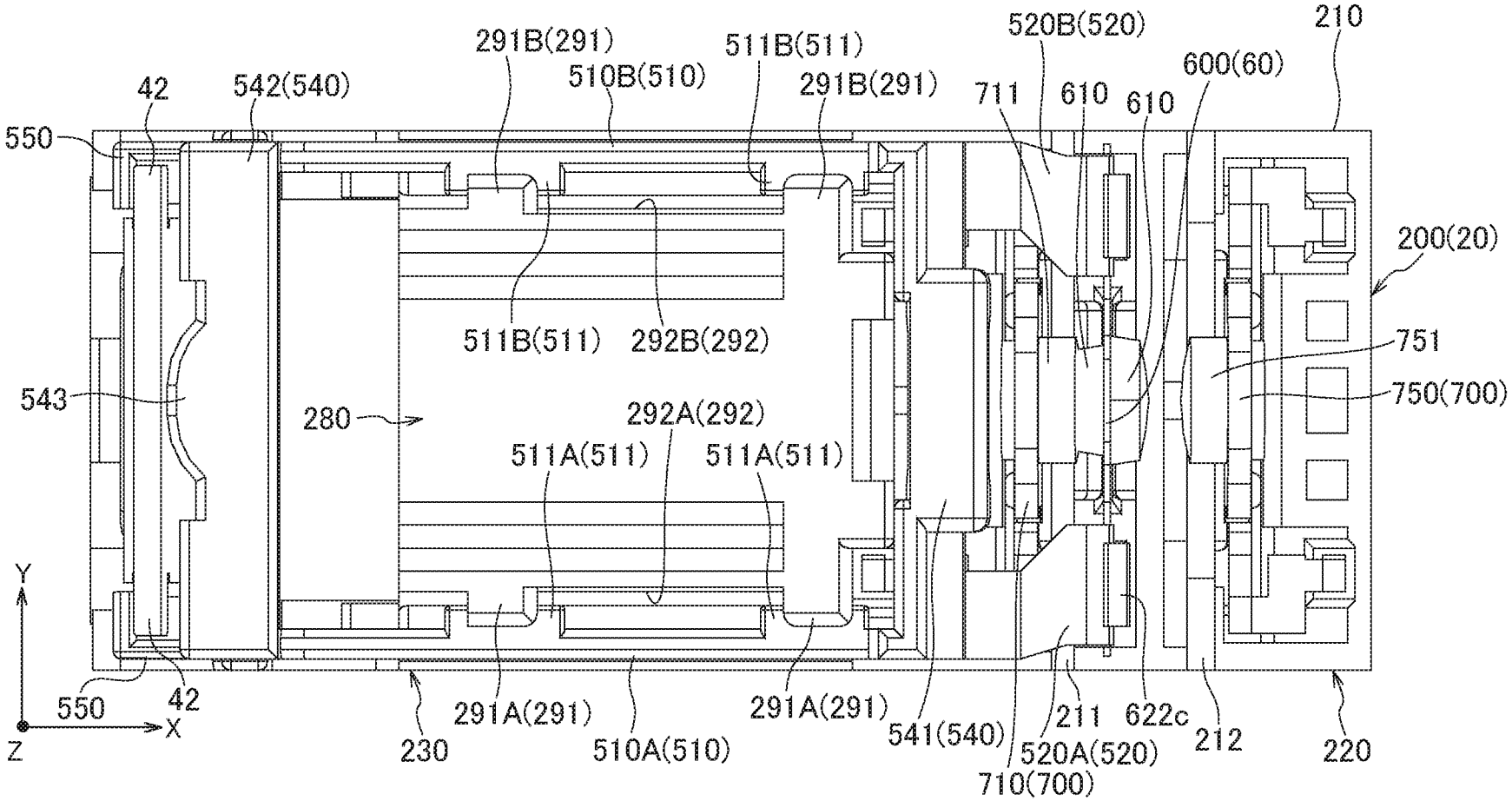
FIG. 26 is a plan view showing a state in which the second fixed contact portion is fixed to the base shown in FIG. 24.

Thereafter, the second fixed contact portion 750 is put and moved downward from above while the tips of the second fixed contact-side terminal portions 753, 753 face downward so as to be fixed to the contact portion fixing portion (the contact portion arrangement region) 220 of the base 200 (refer to FIG. 25 and FIG. 26).

In particular, the tips of the second fixed contact-side terminal portions 753, 753 are inserted to the second fixed contact-side terminal penetration holes 215, 215 of the base 200 from above, and the lower portion of the body portion 752 is press-fitted from above and fixed to the second fixed contact portion press-fit portion 222.

The second fixed contact portion 750 is thus fixed to the contact portion fixing portion (the contact portion arrangement region) 220 of the base 200 while the second fixed contact-side terminal portions 753, 753 are exposed to the outside below the housing 20.

The cover 201 is then placed from above and fixed to the base 200 with an adhesive (not shown), so as to assemble the electromagnetic relay 1.

Although the process of fixing the respective members together is not necessarily limited to the order described above, the card 50 is preferably fixed to the base 200 at least after the movable contact portion 600 and the first fixed contact portion 710 are fixed to the base 200.

The armature 40 is preferably fixed to the card 50 and the electromagnet block 30 at least after the card 50 and the electromagnet block 30 are fixed to the base 200.

The second fixed contact portion 750 is preferably fixed to the base 200 after the armature 40 is fixed to the card 50 and the electromagnet block 30.

Next, the operation of the electromagnetic relay 1 is described below.

When voltage is not applied to the coil 310 (electricity is not supplied), the electromagnet block 30 is in a non-excitation state, and the armature 40 is separated from the magnetic pole (the head 331 of the iron core 330) due to the biasing force of the spring portion 362 of the hinge spring 360. The armature 40 is thus in a state in which the upper end is turned rearward in the front-rear direction (in the X direction). Therefore, the movable contact 610 is in contact with the first fixed contact 711, while the movable contact 610 is separated from the second fixed contact 751.

When the voltage is applied to the coil 310 (the electricity is supplied) to excite the electromagnet block 30, magnetic force is generated between the front surface of the armature 40 and the magnetic pole face (the rear surface) of the magnetic pole (the head 331 of the iron core 330), so that the armature 40 is attracted to the magnetic pole face (the rear surface) of the magnetic pole (the head 331 of the iron core 330). Namely, the armature 40 turns forward on its bottom portion.

In association with the turn (movement, swing) of the armature 40, the pressing portions 520 of the card 50 slide forward so that the pressing portions 520 press the pressed portions 622*a* of the movable contact portion 600 to elastically deform the elastically-deformed portion 620 (the body portion 621 and the branched portion 622, 622) toward the second fixed contact portion 750 (forward). The movable contact 610 provided on the body portion 621 of the elastically-deformed portion 620 is thus separated from the first fixed contact 711, while the movable contact 610 is brought into contact with the second fixed contact 751.

When the voltage application to the coil 30 is stopped (the conduction of the electricity is released), the armature 40 turns rearward on its bottom portion due to the biasing force of the spring portion 362, so that the movable contact 610 is separated from the second fixed contact 751, while the movable contact 610 is brought into contact with the first fixed contact 711.

As described above, the electromagnetic relay 1 according to the present embodiment includes the base 200, the electromagnet block 30 fixed to the base 200, the armature 40 which reciprocates when the electromagnet block 30 is switched between an excitation state and a non-excitation state, and the card 50 which slides in association with the movement of the armature 40.

The electromagnetic relay 1 further includes the movable contact portion 600 provided with the movable contacts 610 and fixed to the base 200, and the fixed contact portion 700 provided with the fixed contacts 711 and 751 brought into contact with and separated from the fixed contacts 610 in association with the movement of the movable contacts 610.

The base 200 includes the rail portions 290 which guide the card 50 upon sliding. The card 50 includes the slide portions 511 which slide along the rail portions 290.

The rail portions 290 are provided with the stopper portions 291 for preventing disengagement of the slide portions 511 from the rail portions 290.

Therefore, the card 50 is not necessarily engaged with the movable contact portion 600, so as to avoid generation of dust caused by scratches on the card 50 when the card 50 is fixed to the base 200, for example.

In the present embodiment, the card 50 is reciprocatively and slidably held to the base 200.

The stopper portions 291 prevent the disengagement of the slide portions 511 from the rail portions 290 wherever the card 50 is located between one end and the other end in the reciprocating range upon sliding.

Thus, the card 50 is prevented from being disengaged from the base 200 during the normal use of the electromagnetic relay 1.

In the present embodiment, the rail portions 290 are provided with the plural stopper portions 291 aligned in the X direction (in the extending direction of the rail portions 290), and also provided with the space 292 between the aligned stopper portions 291 through which the slide portions 511 can be introduced.

The card 50 is reciprocatively and slidably held to the base 200 such that the card 50 is put and moved in the Z direction (in the direction intersecting the extending direction of the rail portions 290) to introduce the slide portions 511 to the rail portions 290 through the spaces 292, and then moved in the X direction (in the extending direction of the rail portions 290) with the slide portions 511 introduced to the rail portions 290 so that the slide portions 511 and the stopper portions 291 at least partly overlap with each other as viewed in the Z direction (in the direction intersecting the extending direction of the rail portions 290).

Accordingly, the card 50 can be fixed to the base 200 more easily.

In the present embodiment, the stopper portions 291 (at least one of the slide portions 511 and the stopper portions 291 for preventing disengagement of the slide portions 511 from the stopper portions 291) are provided with the tapered portions 291*a* (at least one of the tapered portions or the R portions).

The tapered portions 291*a* avoid obstructing the slide portions 511 by the stopper portions 291 when the card 50 is fixed to the base 200, so as to facilitate the fixation of the card 50 to the base 200 more smoothly.

In the present embodiment, the rail portions 290 include the first rail portion 290A and the second rail portion 290B extending substantially in parallel to each other.

The slide portions 511 include the first slide portions 511A which slide along the first rail portion 290A and the second slide portions 511B which slide along the second rail portion 290B.

The stopper portions 291 include the first stopper portions 291A provided in the first rail portion 290A to prevent disengagement of the first slide portions 511A from the first rail portion 290A and the second stopper portions 291B provided in the second rail portion 290B to prevent disengagement of the second slide portions 511B from the second rail portion 290B.

The stopper portions 291 prevent shaking of the card 50 upon sliding so that the card 50 slides more smoothly.

In the present embodiment, the card 50 includes the first slide piece 510A provided with the first slide portions 511A and extending in the X direction (in the extending direction of the first rail portion 290A), the second slide piece 510B provided with the second slide portions 511B and extending in the X direction (in the extending direction of the second rail portion 290B), and the connection portion 540 connecting the first slide piece 510A and the second slide piece 510B.

The two slide pieces 510 are integrated together and thus reinforced, so as to prevent deformation of the card 50. Accordingly, the card 50 can slide more smoothly.

In the present embodiment, the connection portion 540 includes the first connection piece (the first connection portion) 541 connecting the front end of the first slide piece 510A in the X direction (one end of the first slide piece 510A in the extending direction) and the front end of the second slide piece 510B in the X direction (one end of the second slide piece 510B in the extending direction). The connection piece 540 further includes the second connection piece (the second connection portion) 542 connecting the rear end of the first slide piece 510A in the X direction (the other end of the first slide piece 510A in the extending direction) and the rear end of the second slide piece 510B in the X direction (the other end of the second slide piece 510B in the extending direction).

The two slide pieces 510 are integrated together at two portions and therefore further reinforced, so as to prevent deformation of the card 50 more reliably. Accordingly, the card 50 can slide more smoothly.

In the present embodiment, the first rail portion 290A includes the plural first stopper portions 291A aligned in the X direction (in the extending direction of the first rail portion 290A), and the first space 292A between the aligned first stopper portions 291A through which the first slide portion 511A can be introduced.

The second rail portion 290B includes the plural second stopper portions 291B aligned in the X direction (in the extending direction of the second rail portion 290B), and the second space 292B between the aligned second stopper portions 291B through which the second slide portion 511B can be introduced.

The card 50 thus can easily be fixed to the base 200 while the card 50 is simply shifted downward in the Z direction so that the first slide portions 511A are housed in the first rail portion 290A and the second slide portions 511B are housed in the second rail portion 290B.

In the present embodiment, the first slide piece 510A is provided with the plural first slide portions 511A aligned in the X direction (in the extending direction of the first slide piece 510A), and the second slide piece 510B is provided with the plural second slide portions 511B aligned in the X direction (in the extending direction of the second slide piece 510B).

The first stopper portion 291A on the front side (one of the plural first stopper portions 291A) prevents disengagement of the first slide portion 511A on the front side (one of the plural first slide portions 511A) from the first rail portion 290A.

The first stopper portion 291A on the rear side (another one of the plural first stopper portions 291A) prevents disengagement of the first slide portion 511A on the rear side (another one of the plural first slide portions 511A) from the first rail portion 290A.

The second stopper portion 291B on the front side (one of the plural second stopper portions 291B) prevents disengagement of the second slide portion 511B on the front side (one of the plural second slide portions 511B) from the second rail portion 290B.

The second stopper portion 291B on the rear side (another one of the plural second stopper portions 291B) prevents disengagement of the second slide portion 511B on the rear side (another one of the plural second slide portions 511) from the second rail portion 290B.

The card 50 is held to the base 200 at four portions and therefore can be fixed to the base 200 more reliably, so as to prevent shaking of the card 50 upon sliding.

In the present embodiment, the base 200 includes the bottom portion 210 to which the electromagnet block 30, the movable contact portion 600 and the fixed contact portion 700 are fixed, and the insulation wall 240 for insulating the electromagnet block 30 fixed to the bottom portion 210 from the movable contact portion 600 and the fixed contact portion 700 fixed to the bottom portion 210.

The insulation wall 240 includes the partition wall portion 260 connected to the bottom portion 210 to divide the bottom portion 210 into the electromagnet block fixing portion (the electromagnet block arrangement region) 230 and the contact portion fixing portion (the contact portion arrangement region) 220, and the peripheral wall portion 250 connected to the partition wall portion 260 and the bottom portion 210 and covering the circumference of the electromagnet block 30 fixed to the bottom portion 210.

The rail portions 290 are located on the upper side of the peripheral wall portion 250 (on the opposite side of the bottom portion 210 in the peripheral wall portion 250).

The card 50 is held to the base 200 at a position away from the bottom portion 210, so that the card 50 can press around the movable contacts 610 without the configuration complicated. Namely, the card 50 can be simplified.

In the present embodiment, the card 50 is provided with the pressing portions 520 which press the pressed portions 622*a* of the movable contact portion 600, and the pressed portions 622*a* of the movable contact portion 600 are provided with the R portions 622*b* at the side edges brought into contact with the pressing portions 520.

The R portions 622*b* avoid providing sharp edges in the regions brought into contact with the pressing portions 520, and accordingly, the pressing portions 520 can be prevented from being chipped by the pressed portions 622*a*.

In the present embodiment, the armature 40 includes the armature body 41 and the projections 42 projecting outward from the armature body 41. The card 50 includes the mount portions 550 on which the projections 42 are mounted so that the card 50 moves in association with the armature body 41.

Since the armature 40 is mounted on the card 50, the card 50 does not need to be press-fitted to the armature 40, so as to prevent generation of dust caused by scratches on the card 50 during the fixation of the card 50, for example.

In the present embodiment, the fixed contact portion 700 includes the first fixed contact portion 710 located toward the rear side of the base 200 (on one side of the movable contact portion 600 toward the card 50) and including the first fixed contact 711 brought into contact with and separated from the movable contact 610 in association with the movement of the movable contact 610.

The fixed contact portion 700 also includes the second fixed contact portion 750 located toward the front side of the base 200 (on the other side of the movable contact portion 600 opposite to the card 50) and including the second fixed contact 751 brought into contact with and separated from the movable contact 610 in association with the movement of the movable contact 610.

The card 50 is fixed to the base 200 at least after the movable contact portion 600 and the first fixed contact portion 710 are fixed to the base 200.

The armature 40 is fixed to the card 50 and the electromagnet block 30 at least after the card 50 and the electromagnet block 30 are fixed to the base 200.

The second fixed contact portion 750 is fixed to the base 200 after the armature 40 is fixed to the card 50 and the electromagnet block 30.

This process avoids obstructing the movable contact portion 600 by the second fixed contact portion 750 when the card 50 is fixed and the movable contact portion 600 is thus moved forward. Accordingly, deformation of the second fixed contact portion 750 can be prevented.

In the present embodiment, the card 50 is fixed to the base 200 such that the card 50 is moved in the vertical direction (in the direction intersecting the slide direction of the card 50).

The card 50 includes the pressing portions 520 which press the pressed portions 622*a* of the movable contact portion 600.

The pressing portions 520 are provided with the leading portions 530 projecting downward to move the movable contact portion 600 so as to lead the pressing portions 520 to the pressed portions 622*a* of the movable contact portion 600 when the card 50 is moved downward to be attached to the base 200.

When the card 50 is moved downward to be attached to the base 200, the leading portions 530 move the movable contact portion 600 forward, so as to easily lead the pressing portions 520 to the pressed portions 622*a* of the movable contact portion 600. Accordingly, the card 50 can be fixed to the base 200 more easily. According to the present embodiment, the movable contact portion 600 does not need to be moved forward by handwork when the card 50 is moved downward, so as to facilitate the assembly by a machine. The speed of assembling the electromagnetic relay 1 thus can be improved.

In the present embodiment, the leading portions 530 are each provided with the inclined surface 532 on the front side (toward the movable contact portion 600) inclined downward so as to gradually increase the distance from the movable contact portion 600 in the state in which the card 50 is moved downward so as to be attached to the base 200.

The inclined surfaces 532 can move the movable contact portion 600 forward more smoothly, so as to lead the pressing portions 520 to the pressed portions 622*a* of the movable contact portion 600 more reliably.

In the present embodiment, the movable contact portion 600 is provided with the bent portions 622*c* located above the pressed portions 622*a* and bent in the direction away from the leading portions 530 in the state in which the card 50 is moved downward to be attached to the base 200.

The pressing portions 520 thus can be led to the pressed portions 622*a* of the movable contact portion 600 more easily. Particularly, the bent portions 622*c* bent in the direction away from the leading portions 530 can increase a component force in the horizontal direction applied from the card 50, so as to move the movable contact portion 600 forward more reliably.

Alternatively, the movable contact portion 600 may be provided with R portions protruding rearward (toward the leading portions 530) above the pressed portions 622*a* in the state in which the card 50 is moved downward to be attached to the base 200.

The R portions provided above the pressed portions 622*a* of the movable contact portion 600 can also lead the pressing portions 520 to the pressed portions 622*a* of the movable contact portion 600 easily.

In the present embodiment, the movable contact portion 600 includes the press-fit portion 630 press-fitted to the base 200, and the elastically-deformed portion 620 connected to the press-fit portion 630 and elastically deformed.

The elastically-deformed portion 620 is provided with the plural holes 650 aligned in the Y direction (along the boundary L between the elastically-deformed portion 620 and the press-fit portion 630) on the lower side of the elastically-deformed portion 620 (toward the press-fit portion 630).

The plural holes 650 can disperse a stress applied to the boundary L between the elastically-deformed portion 620 and the press-fit portion 630, so as to prevent plastic deformation of the movable contact portion 600.

In the present embodiment, the plural holes 650 are elongated in the Z direction (in the direction intersecting the boundary L).

The elongated holes 650 further facilitate the elastic deformation of the elastically-deformed portion 620, so as to prevent plastic deformation of the movable contact portion 600 more reliably.

In the present embodiment, the fixed contact portion 700 includes the body portions 712 and 752 to which the fixed contacts 711 and 751 are attached, and the terminal portions 713 and 753 connected to the body portions 712 and 752 and inserted to the base 200.

The body portion 712 or 752 and the terminal portions 713 or 753 are formed such that the plate-like fixed contact material 800 is folded down.

The fixed contact material 800 includes the body portion pre-prepared portion 810 to serve as the body portion 712 or 752, and the terminal portion pre-prepared portions 820 to serve as the first fixed contact-side terminal portions 713 or 753.

The terminal portion pre-prepared portions 820 include the base portions 821 connected to the body portion pre-prepared portion 810 on the lower side (on one side), and the tips 822 located on the opposite side of the base portions 821 on the upper side (on the other side) of the body portion pre-prepared portion 810.

The terminal portion pre-prepared portions 820 are folded down such that the tips 822 project downward from the lower side (the one side) of the body portion pre-prepared portion 810 so as to form the fixed contact-side terminal portions 713 or 753.

When the fixed contact material 800 is made of a plate-like member, wasted regions can be reduced (the amount of materials wasted can be decreased), so that the yield of the material can be improved to achieve a reduction in cost accordingly.

In the present embodiment, the fixed contact portion 700 includes the first fixed contact portion 710 located toward the rear side of the base 200 (on one side of the movable contact portion 600 toward the card 50) and including the first fixed contact 711 brought into contact with and separated from the movable contact 610 in association with the movement of the movable contact 610. The fixed contact portion 700 also includes the second fixed contact portion 750 located toward the front side of the base 200 (on the other side of the movable contact portion 600 opposite to the card 50) and including the second fixed contact 751 brought into contact with and separated from the movable contact 610 in association with the movement of the movable contact 610.

The first fixed contact portion 710 and the second fixed contact portion 750 are respectively provided with the body portion 712 and 752 and the terminal portions 713 and 753 formed of the common fixed contact material 800. Namely, the fixed contact material 800 is used for forming the respective body portion 712 and 752 and the respective terminal portions 713 and 753 of the fixed contact portion 700 which includes the fixed contacts 711 and 751, the body portions 712 and 752 to which the fixed contacts 711 and 751 are attached, and the terminal portions 713 and 753 connected to the body portions 712 and 752.

The present embodiment thus does not need to separately prepare a fixed contact material used for forming the body portion 712 and the terminal portions 713 of the first fixed contact portion 710 and a fixed contact material used for forming the body portion 752 and the terminal portions 753 of the second fixed contact portion 750. The common fixed contact material can share a metal mold, so as to further reduce costs.

While the present invention has been described above by reference to the preferred embodiment, the present invention is not intended to be limited to the embodiment, and various modifications will be apparent to those skilled in the art.

For example, the electromagnet block, the contact portions, and other specifications (such as a shape, size, and layout) may be varied as appropriate.

The embodiment described above (including various modified examples) includes the invention for solving the problems described below.

Japanese Patent Application Publication No. 2008-235064 (hereinafter, referred to as "Patent Literature 1") discloses an electromagnetic relay including a movable iron armature which reciprocates when an electromagnet block is switched between an excitation state and a non-excitation state, and a card which slides in association with the movement of the movable iron armature. Movable contacts provided on a movable contact part are moved in association with the slide of the card, so that the movable contacts are brought into contact with and separated from fixed contacts provided on a fixed contact part.

In Patent Literature 1, guide shafts projecting from the card at one end are fitted to guide holes provided in the movable contact part, so that the one end of the card is held to the movable contact part.

A connection part provided at the upper end of the movable iron armature is inserted to an insertion hole serving as a guide portion provided at the other end of the card, so that the other end of the card is held to the movable iron armature. In particular, a fixation projection provided at the connection part of the movable iron armature is fixed to a fixation recess provided at a circumferential edge of the insertion hole.

In Patent Literature 1, the card is thus slidably held such that the one end of the card is fitted to the movable contact part and the other end is fixed to the movable iron armature.

The conventional electromagnetic relay complicates the process of fixing the card since the one end of the card is fitted to the movable contact part and the other end is fixed to the movable iron armature.

The embodiment including various modified examples described above provides an electromagnetic relay which facilitates fixation of a card.

In particular, the electromagnetic relay includes a base, an electromagnet block fixed to the base, an armature which reciprocates when the electromagnet block is switched between an excitation state and a non-excitation state, and a card which slides in association with the movement of the armature. The electromagnetic relay further includes a movable contact portion fixed to the base and including movable contacts which move in association with the slide of the card, and a fixed contact portion fixed to the base and including fixed contacts brought into contact with and separated from the movable contacts in association with the movement of the movable contacts.

The card is fixed to the base such that the card is moved in a direction intersecting the slide direction of the card. The card includes pressing portions which press pressed portions of the movable contact portion. The pressing portions are provided with leading portions projecting downward to move the movable contact portion so as to lead the pressing portions to the pressed portions of the movable contact portion when the card is moved downward to be attached to the base.

The leading portions may each be provided with an inclined surface on the movable contact portion side inclined downward so as to gradually increase a distance from the movable contact portion in the state in which the card is moved downward so as to be attached to the base.

Alternatively, the movable contact portion may be provided with R portions protruding toward the leading portions above the pressed portions in the state in which the card is moved downward to be attached to the base.

The movable contact portion may be provided with bent portions located above the pressed portions and bent in a direction away from the leading portions in the state in which the card is moved downward to be attached to the base.

The movable contact portion may include a press-fit portion press-fitted to the base, and an elastically-deformed portion connected to the press-fit portion and elastically deformed. The elastically-deformed portion is provided with plural holes on the press-fit portion side aligned along a boundary between the elastically-deformed portion and the press-fit portion.

The plural holes may be elongated in a direction intersecting the boundary.

The embodiment described above (including various modified examples) further includes the invention for solving the problems described below.

Japanese Patent Application Publication No. 2008-235064 (hereinafter, referred to as "Patent Literature 1") discloses the electromagnetic relay including the movable iron armature which reciprocates when the electromagnet block is switched between an excitation state and a non-excitation state, and the card which slides in association with the movement of the movable iron armature. The movable contacts provided on the movable contact part are moved in association with the slide of the card, so that the movable contacts are brought into contact with and separated from the fixed contacts provided on the fixed contact part.

In Patent Literature 1, the fixed contact part includes a body portion to which the fixed contact is attached, and a terminal portion connected to the body portion. The body portion and the terminal portion are formed such that a plate-like material is folded down.

The plate-like material includes a body portion pre-prepared portion to serve as the body portion and a terminal portion pre-prepared portion connected to the body portion to serve as the terminal portion. The body portion and the terminal portion of the fixed contact part are obtained such that the terminal portion pre-prepared portion is folded down.

In the conventional electromagnetic relay, the terminal portion pre-prepared portion extends outward from one end of the body portion pre-prepared portion. In other words, the terminal portion pre-prepared portion is elongated such that the tip protrudes in a direction away from the body portion pre-prepared portion.

When the material having such a shape is pressed out of a plate-like member by a metal mold, a region not used for the material in the plate-like member is increased. Namely, the area of the wasted portion not used for the material is increased.

The conventional electromagnetic relay thus has a problem of a decrease in yield, which increases costs.

The embodiment including various modified examples described above provides a fixed contact material capable of achieving a reduction in cost and an electromagnetic relay including a fixed contact portion formed by use of the fixed contact material.

In particular, the electromagnetic relay includes a base, an electromagnet block fixed to the base, an armature which reciprocates when the electromagnet block is switched between an excitation state and a non-excitation state, and a card which slides in association with the movement of the armature.

The electromagnetic relay further includes a movable contact portion fixed to the base and including movable contacts which move in association with the slide of the card, and a fixed contact portion fixed to the base and including fixed contacts brought into contact with and separated from the movable contacts in association with the movement of the movable contacts.

The fixed contact portion includes a body portion to which the fixed contact is attached, and terminal portions connected to the body portion and inserted to the base. The body portion and the terminal portions are formed such that a plate-like fixed contact material is folded down.

The fixed contact material includes a body portion pre-prepared portion to serve as the body portion, and terminal portion pre-prepared portions to serve as the terminal portions.

The terminal portion pre-prepared portions include base portions connected to the body portion pre-prepared portion on one side, and tips located on the opposite side of the base portions on the other side of the body portion pre-prepared portion.

The terminal portion pre-prepared portions are folded down such that the tips project downward from the one side of the body portion pre-prepared portion so as to form the terminal portions.

The fixed contact portion includes a first fixed contact portion located in the base on one side of the movable contact portion toward the card and including a first fixed contact brought into contact with and separated from the movable contact in association with the movement of the movable contact, and a second fixed contact portion located in the base on the other side of the movable contact portion opposite to the card and including a second fixed contact brought into contact with and separated from the movable contact in association with the movement of the movable contact. The first fixed contact portion and the second fixed contact portion may each be provided with the body portion and the terminal portions formed of the common fixed contact material.

The fixed contact material is used for forming the body portion and the terminal portions of each fixed contact portion which includes the fixed contact, the body portion to which the fixed contact is attached, and the terminal portions connected to the body portion.

The fixed contact material includes the body portion pre-prepared portion to serve as the body portion, and the terminal portion pre-prepared portions to serve as the terminal portions.

The terminal portion pre-prepared portions include the base portions connected to the body portion pre-prepared portion on one side, and the tips located on the opposite side of the base portions on the other side of the body portion pre-prepared portion.

The embodiment described above (including various modified examples) further includes the invention regarding a method of fixing a card to a base.

In particular, the embodiment includes the method of fixing a card to a base in an electromagnetic relay, the electromagnetic relay including the base, an electromagnet block fixed to the base, an armature which reciprocates when the electromagnet block is switched between an excitation state and a non-excitation state, the card which slides in association with the movement of the movable iron armature, a movable contact portion fixed to the base and including movable contacts which move in association with the slide of the card, and a fixed contact portion fixed to the base and including fixed contacts brought into contact with and separated from the movable contacts in association with the movement of the movable contacts.

The base of the electromagnetic relay includes rail portions which guide the card upon sliding. The card includes slide portions which slide along the rail portions.

The rail portions are provided with plural stopper portions aligned in the extending direction of the rail portions to prevent disengagement of the slide portions from the rail portions, and also provided with a space between the aligned stopper portions through which the slide portions can be introduced.

The method of fixing the card to the base in the electromagnetic relay having the configuration described above includes the following steps (1) and (2):

(1) The step of moving the card in a direction intersecting the extending direction of the rail portions to introduce the slide portions to the rail portions through the space.

(2) The step of slidably holding the card to the base by moving the card in the extending direction of the rail portions in a state in which the slide portions are introduced to the rail portions so that the slide portions and the stopper portions at least partly overlap with each other.

The embodiment described above (including various modified examples) further includes the invention regarding a method of forming the fixed contact portion including a body portion and terminal portions by use of a fixed contact material.

In particular, the fixed contact material includes a body portion pre-prepared portion to serve as the body portion, and terminal portion pre-prepared portions to serve as the terminal portions.

The terminal portion pre-prepared portions include base portions connected to the body portion pre-prepared portion on one side, and tips located on the opposite side of the base portions on the other side of the body portion pre-prepared portion.

A method of forming the fixed contact portion including the body portion and the terminal portions by use of the fixed contact material includes the following step:

The step of folding down the terminal portion pre-prepared portions such that the tips project from one side of the body portion pre-prepared portion so as to form the body portion and the terminal portions.

This application claims the benefit of priority from Japanese Patent Applications No. 2015-181967, No. 2015-181974, and No. 2015-181980, each filed on Sep. 15, 2015, the contents of which are herein incorporated by reference in their entireties.

INDUSTRIAL APPLICABILITY

The present invention can provide an electromagnetic relay capable of preventing generation of dust caused by scratches on a card.

The invention claimed is:

1. An electromagnetic relay comprising:

a base;

an electromagnet block fixed to the base;

an armature configured to reciprocate when the electromagnet block is switched between an excitation state and a non-excitation state;

a card configured to slide in association with a movement of the armature;

a movable contact portion fixed to the base and including a movable contact which moves in association with a slide of the card; and a fixed contact portion fixed to the base and including a fixed contact brought into contact with and separated from the movable contact in association with a movement of the movable contact, the base including a rail portion configured to guide the card upon sliding, the card including a slide portion configured to slide along the rail portion, the rail portion including a stopper portion to prevent disengagement of the slide portion from the rail portion, the rail portion being provided with plural stopper portions each corresponding to the stopper portion and aligned in an extending direction of the rail portion, and provided with a space between the aligned stopper portions through which the slide portion is introducible, and the card being slidably held to the base such that the card is movable in a direction intersecting the extending direction of the rail portion so that the slide portion is introduced to the rail portion through the space, and the card is movable in the extending direction of the rail portion in a state in which the slide portion is introduced in the rail portion so that the slide portion and the stopper portions at least partly overlap with each other as viewed in the direction intersecting the extending direction of the rail portion.

2. The electromagnetic relay according to claim 1, wherein:

the card is reciprocatively and slidably held to the base; and the stopper portion prevents the disengagement of the slide portion from the rail portion wherever the card is located between one end and another end in a reciprocative range upon sliding.

3. The electromagnetic relay according to claim 1, wherein at least one of the slide portion and the stopper portions for preventing the disengagement of the slide portion from the rail portion is provided with at least one of a tapered portion and a radiused portion.

4. The electromagnetic relay according to claim 1, wherein:

the rail portion includes a first rail portion and a second rail portion extending in parallel to each other;

the slide portion includes a first slide portion which slides along the first rail portion, and a second slide portion which slides along the second rail portion; and the stopper portion includes a first stopper portion provided in the first rail portion to prevent disengagement of the first slide portion from the first rail portion, and a second stopper portion provided in the second rail portion to prevent disengagement of the second slide portion from the second rail portion.

5. An electromagnetic relay comprising:

a base;

an electromagnet block fixed to the base;

an armature configured to reciprocate when the electromagnet block is switched between an excitation state and a non-excitation state;

a card configured to slide in association with a movement of the armature;

a movable contact portion fixed to the base and including a movable contact which moves in association with a slide of the card; and a fixed contact portion fixed to the base and including a fixed contact brought into contact with and separated from the movable contact in association with a movement of the movable contact, the base including a rail portion configured to guide the card upon sliding, the card including a slide portion configured to slide along the rail portion, the rail portion including a stopper portion to prevent disengagement of the slide portion from the rail portion, the rail portion including a first rail portion and a second rail portion extending in parallel to each other, the slide portion including a first slide portion which slides along the first rail portion, and a second slide portion which slides along the second rail portion, the stopper portion including a first stopper portion provided in the first rail portion to prevent disengagement of the first slide portion from the first rail portion, and a second stopper portion provided in the second rail portion to prevent disengagement of the second slide portion from the second rail portion, the first rail portion being provided with plural first stopper portions each corresponding to the first stopper portion and aligned in an extending direction of the first rail portion, and provided with a first space between the aligned first stopper portions through which the first slide portion can be introduced, and the second rail portion being provided with plural second stopper portions each corresponding to the second stopper portion and aligned in an extending direction of the second rail portion, and provided with a second space between the aligned second stopper portions through which the second slide portion can be introduced.

6. The electromagnetic relay according to claim 4, wherein the card includes a first slide piece provided with the first slide portion and extending in the extending direction of the first rail portion, a second slide piece provided with the second slide portion and extending in the extending direction of the second rail portion, and a connection portion connecting the first slide piece and the second side piece.

7. The electromagnetic relay according to claim 6, wherein the connection portion includes a first connection portion connecting the first slide piece on one side in the extending direction and the second slide piece on one side in the extending direction, and a second connection portion connecting the first slide piece on another side in the extending direction and the second slide piece on another side in the extending direction.

8. The electromagnetic relay according to claim 6, wherein:

the first slide piece is provided with plural first slide portions each corresponding to the first slide portion and aligned in the extending direction of the first slide piece, and the second slide piece is provided with plural second slide portions each corresponding to the second slide portion and aligned in the extending direction of the second slide piece;

one of the plural first stopper portions prevents disengagement of one of the plural first slide portions from the first rail portion, and another one of the plural first stopper portions prevents disengagement of another one of the plural first slide portions from the first rail portion; and one of the plural second stopper portions prevents disengagement of one of the plural second slide portions from the second rail portion, and another one of the plural second stopper portions prevents disengagement of another one of the plural second slide portions from the second rail portion.

9. An electromagnetic relay comprising:

a base;

an electromagnet block fixed to the base;

an armature configured to reciprocate when the electromagnet block is switched between an excitation state and a non-excitation state;

a card configured to slide in association with a movement of the armature;

a movable contact portion fixed to the base and including a movable contact which moves in association with a slide of the card; and a fixed contact portion fixed to the base and including a fixed contact brought into contact with and separated from the movable contact in association with a movement of the movable contact, the base including a rail portion configured to guide the card upon sliding, the card including a slide portion configured to slide along the rail portion, the rail portion including a stopper portion to prevent disengagement of the slide portion from the rail portion, the base including a bottom portion to which the electromagnet block, the movable contact portion and the fixed contact portion are fixed, and an insulation wall insulating the electromagnet block fixed to the bottom portion from the movable contact portion and the fixed contact portion fixed to the bottom portion, the insulation wall including a partition wall portion connected to the bottom portion to divide the bottom portion into an electromagnet block arrangement region and a contact portion arrangement region, and a peripheral wall portion connected to the partition wall portion and the bottom portion to cover a circumference of the electromagnet block fixed to the bottom portion, and the rail portion being located in the peripheral wall portion on an opposite side of the bottom portion.

10. The electromagnetic relay according to claim 1, wherein:

the card is provided with a pressing portion which presses a pressed portion of the movable contact portion; and the pressed portion of the movable contact portion is provided with a radiused portion at a side edge brought into contact with the pressing portion.

11. The electromagnetic relay according to claim 1, wherein:

the armature includes an armature body, and a projection projecting outward from the armature body; and the card includes a mount portion on which the projection is mounted so that the card moves in association with a movement of the armature body.

12. The electromagnetic relay according to claim 1, wherein:

the fixed contact portion includes a first fixed contact portion located on one side of the movable contact portion toward the card in the base and including a first fixed contact brought into contact with and separated from the movable contact in association with the movement of the movable contact, and a second fixed contact portion located on another side of the movable contact portion opposite to the card in the base and including a second fixed contact brought into contact with and separated from the movable contact in association with the movement of the movable contact;

the card is fixed to the base at least after the movable contact portion and the first fixed contact portion are fixed to the base;

the armature is fixed to the card and the electromagnet block at least after the card and the electromagnet block are fixed to the base; and the second fixed contact portion is fixed to the base after the armature is fixed to the card and the electromagnet block.

13. The electromagnetic relay according to claim 1, wherein:

the card is moved in a direction intersecting a slide direction of the card so that the card is fixed to the base;

the card is provided with a pressing portion which presses a pressed portion of the movable contact portion; and the pressing portion is provided with a leading portion projecting downward to move the movable contact portion so as to lead the pressing portion to the pressed portion of the movable contact portion in a state in which the card is moved downward to be attached to the base.

14. The electromagnetic relay according to claim 13, wherein the leading portion is provided with an inclined surface toward the movable contact portion inclined downward so as to gradually increase a distance from the movable contact portion in the state in which the card is moved downward to be attached to the base.

15. The electromagnetic relay according to claim 13, wherein the movable contact portion is provided with a radiused portion protruding toward the leading portion above the pressed portion in the state in which the card is moved downward to be attached to the base.

16. The electromagnetic relay according to claim 13, wherein the movable contact portion is provided with a bent portion bent above the pressed portion in a direction away from the leading portion in the state in which the card is moved downward to be attached to the base.

17. The electromagnetic relay according to claim 13, wherein:

the movable contact portion includes a press-fit portion press-fitted to the base, and an elastically-deformed portion connected to the press-fit portion and elastically deformed; and the elastically-deformed portion is provided with a plurality of holes toward the press-fit portion aligned along a boundary between the elastically-deformed portion and the press-fit portion.

18. The electromagnetic relay according to claim 17, wherein the plural holes are elongated in a direction intersecting the boundary.

* * * * *